US008136354B2

(12) United States Patent
Havel

(10) Patent No.: US 8,136,354 B2
(45) Date of Patent: Mar. 20, 2012

(54) ADSORPTION-ENHANCED COMPRESSED AIR ENERGY STORAGE

(75) Inventor: Timothy F. Havel, Boston, MA (US)

(73) Assignee: Energy Compression Inc., Boston, MA (US)

( * ) Notice: Subject to any disclaimer, the term of this patent is extended or adjusted under 35 U.S.C. 154(b) by 29 days.

(21) Appl. No.: 12/854,969

(22) Filed: Aug. 12, 2010

(65) Prior Publication Data

US 2011/0023476 A1 Feb. 3, 2011

Related U.S. Application Data

(63) Continuation of application No. PCT/US2010/036334, filed on May 27, 2010, which is a continuation-in-part of application No. PCT/US2009/001655, filed on Mar. 16, 2009, now abandoned.

(60) Provisional application No. 61/036,587, filed on Mar. 14, 2008, provisional application No. 61/181,492, filed on May 27, 2009, provisional application No. 61/225,399, filed on Jul. 14, 2009, provisional application No. 61/248,057, filed on Oct. 2, 2009.

(51) Int. Cl.
*F16D 31/02* (2006.01)
*F01K 3/00* (2006.01)

(52) U.S. Cl. ..... 60/412; 60/413; 60/659

(58) Field of Classification Search ..... 60/407, 60/408, 412, 413, 650, 655, 659, 670, 682
See application file for complete search history.

(56) References Cited

U.S. PATENT DOCUMENTS

| | | | | |
|---|---|---|---|---|
| 5,537,822 | A | 7/1996 | Shnaid et al. | |
| 2009/0158740 | A1 * | 6/2009 | Littau et al. | 60/659 |

FOREIGN PATENT DOCUMENTS

| | | | |
|---|---|---|---|
| JP | 02-188628 | A | 7/1990 |
| JP | 03-185222 | A | 8/1991 |
| JP | 07-119485 | A | 5/1995 |
| JP | 2000-297657 | A | 10/2000 |

* cited by examiner

*Primary Examiner* — Michael Leslie
(74) *Attorney, Agent, or Firm* — Nelson Mullins Riley & Scarborough LLP; Anthony A. Laurentano

(57) ABSTRACT

In an embodiment of the present disclosure, an energy storage device is presented. The energy storage device includes a porous material that adsorbs air and a compressor. The compressor converts mechanical energy into pressurized air and heat, and the pressurized air is cooled and adsorbed by the porous material. The energy storage device also includes a tank used to store the pressurized and adsorbed air and a motor. The motor is driven to recover the energy stored as compressed and adsorbed air by allowing the air to desorb and expand while driving the motor.

16 Claims, 27 Drawing Sheets

ADSORPTION-ENHANCED COMPRESSED AIR ENERGY STORAGE

CROSS REFERENCE TO RELATED APPLICATIONS

This patent application is a continuation of International Application No, PCT/US2010/036334 filed on May 27, 2010 which is a continuation-in-part of PCT/US2009/001655 filed Mar. 16, 2009, now abandoned, which claims the benefit of U.S. Provisional Application Ser. No. 61/036,587, filed on Mar. 14, 2008. International Patent Application No. PCT/US2010/036334 claims the benefit of U.S. Provisional Application Ser. No. 61/181,492 filed on May 27. 2009, U.S. Provisional Application Ser. No. 61/225,399 filed on Jul. 14, 2009 and U.S. Provisional Application Ser. No. 61/248,057 filed on Oct. 2, 2009, by Timothy F. Havel. The contents of each of these applications being incorporated herein by reference in their entireties.

BACKGROUND

1. Technical Field

The present disclosure relates to the field of energy storage. In particular, the present disclosure is directed to an energy storage device that includes a pressure chamber containing a porous material that adsorbs air.

2. Description of the Related Art

Compressed air energy storage is commonly known by its acronym "CAES." In some CAES devices, the air compressor is driven by an electric motor, and subsequently used to drive an air motor or turbine connected to an electromagnetic generator, thereby forming the functional equivalent of an electrochemical battery. If the charge-discharge cycle is carried out slowly enough to be approximately isothermal, meaning that the heat generated by compression dissipates without raising the temperature of the air appreciably during compression, and the heat drawn in from the environment likewise keeps the air from cooling appreciably during expansion, this form of electricity storage can have good efficiency.

CAES systems can also be engineered to have higher reliability, lower maintenance and longer operating lifetimes than chemical batteries, and their cost can be comparable to battery-based systems providing that an inexpensive means of storing the compressed air is available. Unfortunately, the high cost, weight and large size of manufactured pressure vessels in which to store the air, such as steel tanks, prevents CAES devices from competing with batteries in all of their usual applications.

To date CAES has been used for three commercial purposes. The first and most widespread use is not as a means of energy storage per se, but to power pneumatic tools and machines in shops and factories. Pneumatic tools have higher weight-to-power ratios than electrically powered tools, and the small electric motors in such tools also tend to be inefficient compared to the larger motors that drive air compressors. The compressed air is stored in a tank big enough to serve as a buffer and ensure that the pressure in the system stays constant. The overall efficiency of these systems is limited by the fact that they discard the heat of compression and do not reheat the air during its rapid expansion. This inefficiency is limited by using modest pressures, usually less than ten atmospheres, which also reduces the capital costs of such CAES systems.

The second use of CAES is for temporary backup power to keep essential machinery running in the event of a power failure, for example in computer data centers or hospitals. In such cases floor space is at a premium, necessitating the use of pressures of a hundred or more atmospheres to attain a relatively high energy density, but the cost of the high-pressure steel storage tanks for the compressed air is justified by the high reliability of the system and the high power it can immediately deliver in the event of a power failure. Subsequently a longer-term backup system like a diesel generator can be brought online if need be. Although the same functionality could be obtained from electrochemical batteries, a battery system that could deliver enough power would also have to store more energy than was needed while waiting for the long-term backup system to come online, making batteries a relatively expensive solution. A CAES system also requires less maintenance, has a longer lifetime, and does not have the disposal costs associated with environmentally hazardous chemicals. Other such short-term backup power solutions include supercapacitors and flywheels, which are likewise relatively costly.

The third commercial use to which CAES has been put is to lower the cost of generating and/or distributing electric power by utility companies. This can be done in several ways, the most common of which is to enhance central generation capacity. Large central power plants such as coal and nuclear are expensive to stop and start, while smaller plants such as gas-fired turbines are readily turned off and on but are comparatively expensive to operate. Hence, if the energy from large plants can be stored when demand is low and used to produce electricity when demand is high, the need to install and operate small peak-load plants can be reduced, thereby also reducing the average or "levelized" cost of producing electricity.

SUMMARY OF THE INVENTION

In an embodiment of the present disclosure, an energy storage device is presented. The energy storage device includes a porous material that adsorbs air and a compressor. The compressor converts mechanical energy into pressurized air and heat, and the pressurized air is cooled and adsorbed by the porous material. The energy storage device also includes a tank used to store the pressurized and adsorbed air and a motor. The motor is driven to recover the energy stored as compressed and adsorbed air by allowing the air to desorb and expand while driving the motor.

In another embodiment of the present disclosure, another energy storage device is presented. The energy storage device includes a porous material, where a suitable fluid has been adsorbed. The device also includes a compressor that converts mechanical energy into pressurized air and heat and a barrier. The pressurized air is cooled by allowing the heat to flow through the barrier, the heat is transported to the porous material to which a fluid has been adsorbed, and the heat raises the temperature of the porous material, causing the fluid to desorb from it. The heat is recovered, and used to keep the temperature of the expanding air from falling and lowering the work done while driving a motor, by allowing the fluid to re-adsorb to the porous material.

In yet another embodiment, another energy storage device is presented. The energy storage device includes a porous material that adsorbs air and a thermal energy storage system that stores heat. The device further includes a compressor that converts mechanical energy into pressurized air and heat. The pressurized air is cooled and adsorbed by the porous material and the temperature of the porous material and surrounding air is controlled by allowing the heat to flow through a barrier that prevents the pressurized and adsorbed air from escaping. The heat is directed to the thermal energy system and is stored there. Further, the device includes a tank that stores the pressurized and adsorbed air, and the energy it contains is recovered when needed by directing the heat stored in the thermal energy storage system back through the barrier, causing the air to desorb, and allowing it to expand and do work in the process.

BRIEF DESCRIPTION OF THE DRAWINGS

An exemplary embodiment and related extrapolated experimental data are illustrated in FIGS. 1 through 11. A second exemplary embodiment and additional extrapolations of experimental data are illustrated in FIGS. 12 through 23.

DETAILED DESCRIPTION OF THE INVENTION

Figure 1:
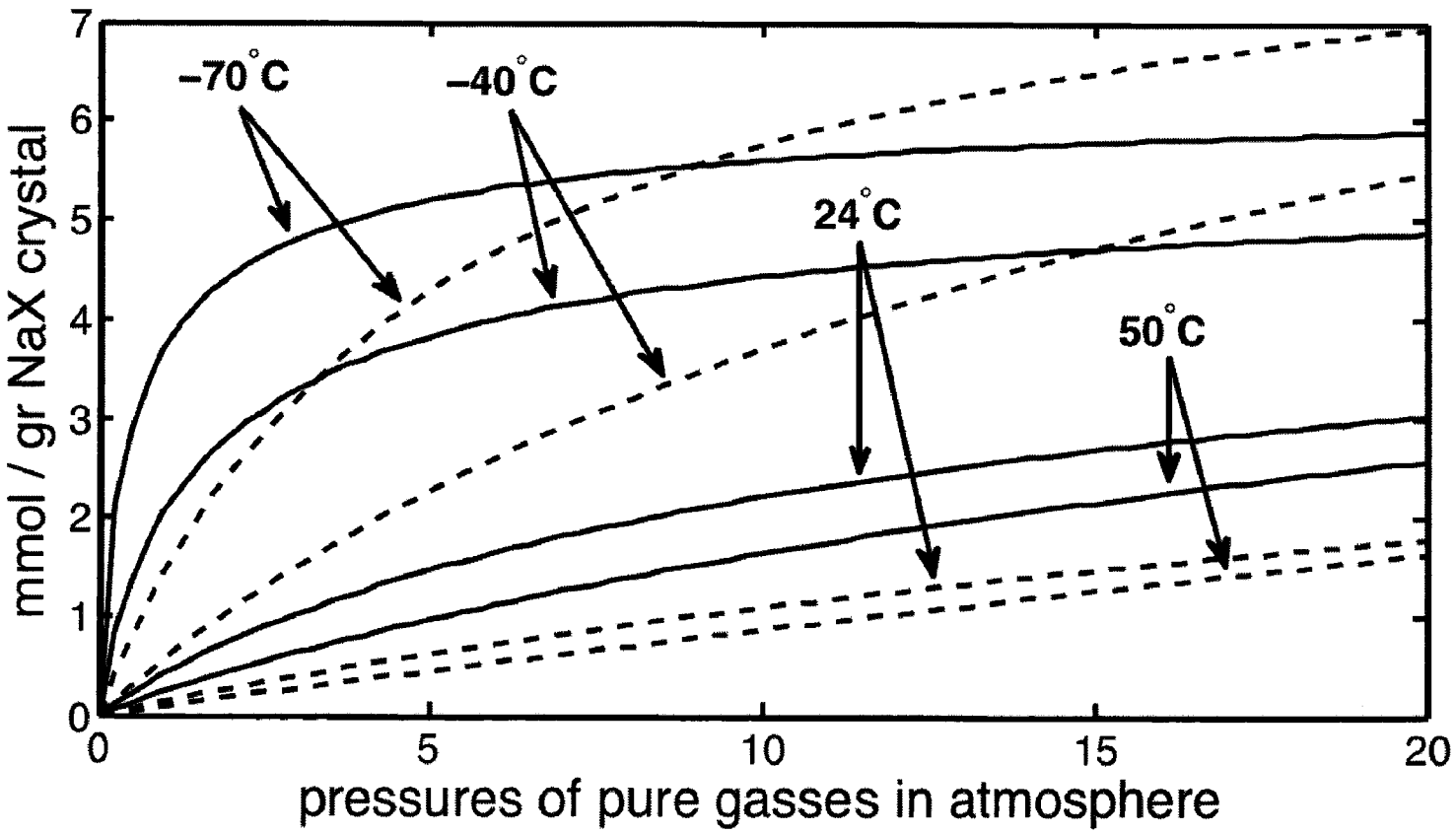
FIG. 1 plots adsorption isotherms for the principal constituents of air on the zeolite NaX.

The present disclosure provides, uses for the physical process of adsorption in porous materials, which greatly improve the economics of compressed air energy storage (CAES). Further the present disclosure provides several improvements to devices that store energy in the form of compressed air, and that may also store some of the energy in the form of sensible or latent heat.

In order to make the use of CAES for central generation capacity cost effective, the compressed air is presently stored in underground geological reservoirs such as natural aquifers or man-made depleted gas or oil wells, rather than in manufactured tanks. The economics is further improved by using the compressed air to turbo-charge a gas-fired turbine, thereby, saving the turbine from having to expend energy compressing the air itself. This allows the energy stored in the compressed air to be recovered while at the same time generating additional energy from natural gas. Although the pressures required for turbo-charging are fairly high, of order 50 or so atmospheres, turbocharging allows the stored energy to be delivered at a high power level and recovered with an overall efficiency of about 70%.

A somewhat different approach to using CAES for utility purposes, which has yet to be commercially deployed, is known as "advanced adiabatic CAES." In AA-CAES, the heat extracted from the air during compression is stored and used to reheat the air during expansion as it powers an air motor or turbine. In principle, this allows both the energy stored as heat and stored as compressed air to be recovered, so the efficiency of AA-CAES can approach 100% in principle. In practice, it is difficult to store and recover the heat of compression without significant losses especially at high power levels. In all the proposed embodiments of AA-CAES to date, the air is again to be stored in underground reservoirs at high pressure, and the heat is to be stored in sensible rather than latent form, usually at temperatures well above 200° C.

Energy storage has the potential to reduce the operating costs of electric utilities in several other ways as well, although none have yet come into widespread use. These include transmission capacity deferral and congestion reduction, various ancillary services, bulk electricity price arbitrage, and load shifting or leveling at the end-user level. In the future, however, the most valuable use of energy storage is likely to be renewable capacity firming. Renewable energy sources such as wind and solar tend to be intermittent, so that their capacity varies in time and is often not sufficient to satisfy the demand for electricity. If the energy can be stored at times when capacity exceeds demand and used to produce electricity when demand exceeds capacity, these renewable energy sources will become much more cost effective.

The main drawback of existing CAES systems in any of the foregoing applications is that suitable underground reservoirs are neither common nor transportable. A modular system that could be assembled anywhere and scaled to the size of the power plant there would, if cost effective, be much more useful for central generation capacity as well as renewable capacity firming. In addition, if it were possible to deliver inexpensive, self-contained CAES systems to well-chosen locations on the grid, nearer to substations or end users. CAES could provide some or all of the other cost reduction services mentioned above. The main reason that such CAES systems are not presently cost-effective is, once again, the high cost of manufactured storage tanks for compressed air. It should be noted that, to a first-order approximation, the cost of the tank is independent of the pressure at which the air is stored, since raising the pressure allows the tank to be made smaller but requires its walls to become proportionately thicker, and vice versa.

One approach to making CAES systems more economical, which has not received much attention, is to take advantage of the fact that the compression and expansion of air is a facile means of pumping heat from one place to another. This means that a CAES system could easily be developed to provide combined heat, cooling and power to end users. If such a CAES system were installed in a home or business where time of day electricity pricing is available, for example, it could be charged during the night when the electricity is relatively inexpensive while simultaneously providing heat to the building, and the electricity it produced used or sold back to the grid, during peak daytime hours while also providing air conditioning. During the winter, when the cooling was not needed, a flat-plate solar collector could be used to heat water, and this hot water used to provide heat for the air during expansion, increasing the power output significantly with only a modest increase in cost. The economics of such a system would depend on many factors including the utility tariffs, the prevailing climate, and of course the cost of the air storage tank.

The storage of gases and of heat can be accomplished by adsorption in suitable porous materials such as activated carbon, silica gel or zeolite. Gases are more easily stored in the presence of such a material because the adsorbed phase is much denser than the free gas, thus reducing the volume of the tank required to store a given mass of the gas at a given pressure, or equivalently the pressure required at a given volume. In addition, heat may be stored in latent form using adsorbent materials because the process of desorption consumes heat. The heat may subsequently be regenerated by allowing the adsorbate (e.g. water vapor) to be re-adsorbed by the adsorbent. Additionally, the heat released upon condensation of the desorbed vapor may be stored in sensible form, and recovered by using it to promote the evaporation of the condensate and then allowing the resulting vapor to re-adsorb. Such a device can include an adsorption refrigerator or heat pump. Nevertheless there have been no attempts to use the process of adsorption in any of these ways to make CAES systems less expensive, more efficient or transportable, better suited to combined heat-and-power applications, and/or safer to deploy.

The present disclosure improves upon the economics of compressed air energy storage in four interrelated ways. The first is the use of an adsorbent for air in order to reduce the pressure in and/or volume of the vessel needed to store a given quantity of energy in the form of compressed air. The second is the desorption of water or some other suitable fluid, possibly combined with storage of the low-grade sensible heat released upon condensation of the vapor thereby produced, as a means of storing the heat of compression so as to make AA-CAES more economical. The third is to store the heat generated by adsorption of the air, possibly along with the heat of compression, and to recover this energy at a later time by using it to raise the temperature of the adsorbent material and/or the compressed air as it expands. The fourth is a new thermodynamic cycle, for CAES, in which the temperature of the compressed air is varied so as to keep the pressure of the stored air approximately constant over the charge/discharge cycle. This "temperature-swing" cycle is especially advantageous when an adsorbent for air is utilized, as just described, and it is also applicable when the heat of compression and/or adsorption is stored for subsequent use, for example by means of an adsorbent for water or some other suitable fluid. The use of a temperature-swing cycle in adsorption-based gas separation processes is well established (see, for example, USPTO Pub. No, 2006/0230930).

It should be noted that energy can be stored by compressing gases other than air, and that a regenerative braking system has been proposed that utilizes adsorbent materials to enhance this process (see, for example, U.S. Pat. No. 7,152,932). This has the advantage that other gases may be more compressible and also more strongly taken up by common adsorbents than is air, allowing energy to be stored more densely than could be done when using air as the working fluid. The main difference between this kind of system and those under consideration here is that the use of any fluid other than air necessitates a closed system in which the fluid can be recycled and reused. In contrast, air can be taken freely from the environment and released again without environmental consequences. This leads to an open system which is much more economical for large-scale energy storage at the end user, electric substation or power plant level. The present disclosure describes the use of adsorbents for air in large-scale, stationary energy storage applications, the desorption of water or some other suitable fluid as a means of storing the heat of compression and/or adsorption of the air, and CAES systems that use a temperature-swing cycle. None of these processes are suitable for small-scale, mobile applications such as regenerative braking.

Although several kinds of porous materials are known that adsorb the nitrogen and oxygen constituents of air to some degree, an adsorption-enhanced CAES embodiment of the present invention utilizes a zeolite material for this purpose. At modest pressures and ambient temperatures, zeolites adsorb nitrogen more strongly than oxygen, and so have been extensively utilized to separate the oxygen and nitrogen constituents of air for industrial and medical purposes. Nevertheless, there have been few detailed studies of the adsorption of air to zeolites or other porous materials at the relatively high pressures of interest for CAES. For example, the temperature-pressure boundary at which the air in zeolites liquefies has not been mapped out in any detail. This process, also called capillary condensation, is not normally observed at temperatures well above the critical point of the adsorbate gas, or about −140° C. in the case of air. Such a low temperature would be difficult to achieve in a cost-effective adsorption-enhanced CAES device.

Thus a new use of adsorption in porous materials provided by the present disclosure is as a means of reducing the volume of the tank needed to store a given mass of air at a given pressure and temperature, or alternatively, of reducing the thickness of the walls of the tank or the strength of the materials of which it is made, by reducing the pressure needed to store a given mass of air in a given volume and at a given temperature. Either of these two alternatives may be achieved by placing a suitable porous material inside the pressure chamber that holds the compressed air, where said porous material adsorbs a greater volume of air than the material itself occupies at the temperature and pressure of the compressed air in the chamber. Such porous materials exist by virtue of the fact that, at equilibrium with the temperature and pressure fixed at suitable values, air molecules in an adsorbed state have greatly reduced mobility and a much higher density than those in the gaseous air around them.

Likewise, another new use of adsorption in porous materials is as a means of storing the heat generated by the process of compressing the air, and/or the heat generated by the process of adsorption of the air as in the first new use above. This second new use is achieved by placing a porous material to which water or some other suitable fluid is adsorbed in thermal contact with, but outside of, the air compressor and/or pressure chamber. The porous material of the second new use need not be the same kind of material as that of the first new use. The heat increases the temperature of this porous material and so promotes desorption of the water or other fluid from it. At the molecular level, this process converts kinetic energy into potential energy, which may then be stored indefinitely by preventing the vapor produced by desorption from coming back into contact with the porous material and being re-adsorbed. This may be described by saying that the heat has been stored in latent form. The transfer of heat from the compressed air to the porous material of the second new use reduces the temperature of the compressed air, thereby also reducing the work needed to further compress it, as well as the size or strength of the tank in which it is stored. Similarly, the cooling of the porous material of the first new use, which is concomitant upon transferring the heat of adsorption from it, increases the amount of air that it adsorbs at any given pressure.

In order to recover the stored latent heat in sensible form, the vapor produced by desorption of the fluid must be available for re-adsorption when needed. Unfortunately, the large volume occupied by the vapor makes it difficult to store in that form, and compressing or condensing it releases a smaller but still significant amount energy in the form of sensible heat. It is nevertheless possible to store this sensible heat, and to subsequently use the process of expansion of the vapor or evaporation of the liquid to harvest this heat and so regenerate the vapor. The advantage of doing this, instead of storing the heat generated by compression and/or adsorption of the air directly in sensible form, lies in the fact that in the former case the sensible heat is contained in a material at a lower temperature that can be more easily insulated against losses. While such low-grade heat is normally difficult to harvest, i.e. to convey to where it is needed, the process of expansion or evaporation serves to refrigerate this material and so pump the heat from it much more rapidly and efficiently than could otherwise be done. This could also, in principle, be done directly by using the compressed air as a refrigerant, but it is difficult to both transfer large quantities of low-grade heat from a solid or liquid material into the expanding air and at the same time to capture the mechanical energy generated. It also takes energy to convert low-grade heat to the high-grade heat needed to facilitate the rapid expansion and/or promote desorption of the air.

Regardless of how the vapor needed is obtained, the latent heat may be recovered, along with the energy stored as compressed and/or adsorbed air, in mechanical form by placing the porous material of the second new use in thermal contact with the air motor or turbine and at the same time allowing the water or other fluid vapor to re-adsorb to it. The sensible heat generated as the water or other fluid re-adsorbs is conducted or otherwise transferred to the compressed air as it expands in the air motor or turbine, raising its temperature and pressure so that it does more useful work. At the same time this transfer of heat cools the porous material of the second new use and so further promotes the spontaneous re-adsorption of water or some other suitable fluid to it. Similarly, the transfer of heat from this porous material to the porous material of the first new use promotes the desorption of air from it at the pressure in the chamber, and this compressed air may then be converted back to mechanical energy via the air motor or turbine as just described.

When porous materials are incorporated into a CAES device for either of these two new uses, we shall refer to the resulting process as adsorption-enhanced CAES, o AE-CAES and to the energy storage device itself as AE-CAES device or AE-CAES system.

This disclosure further provides a new use for the industrial process of temperature-swing adsorption, which has been widely employed as a means of separating mixtures of fluids. In this process, the temperature of the air and of the porous material to which air is adsorbed is lowered when charging the CAES device with energy, and raised again when discharging it, all the while pumping air in or allowing air to escape from the pressure chamber at a rate that keeps the pressure of the compressed air therein approximately constant.

A constant air pressure will simplify the construction and operation of any CAES device, but more important for the purposes of the present invention is the fact that the temperature-swing process is a convenient means of increasing the amount of air stored and released by any given quantity of porous material as in the first new use. It does this because the quantity of a as adsorbed by the vast majority of known porous materials decreases rapidly as the temperature thereof is raised, and vice versa. It follows that if the minimum temperature, attained when the AE-CAES device is in its charged state, is low enough to ensure that the porous material is largely saturated by air at the working pressure of the device, while the maximum temperature, attained when the AE-CAES device is in its discharged state, is high enough to ensure that most of the air is desorbed from the material at the working pressure of the device, then one will obtain a greater benefit from the chosen porous material of the first new use than if a pressure-swing cycle had been utilized, at least without the costly and energy consuming expedient of going to subatmospheric pressures. This includes a pressure-swing cycle with either a constant temperature, or with the spontaneous temperature variation of the pressure-swing cycle which reaches its minimum temperature in the discharged state and its maximum in the charged state.

For each of the two new uses of the physical process of adsorption given above, a variety of porous materials are available by which useful embodiments of the invention may be constructed. In an AE-CAES embodiment that will now be described in detail, the first new use is implemented by a zeolite known as NaX. This is a widely available Faujasite-type zeolite containing sodium ions, which is commonly sold under the commercial name of 13X.

Dry air is about 78% nitrogen, 21% oxygen and 1% argon by mole fraction. Like most naturally and/or commercially available zeolites, NaX adsorbs nitrogen more strongly than oxygen or argon, i.e. on a molar basis it adsorbs more nitrogen than oxygen or argon when placed under these pure gases at a given pressure and temperature—at least at the relatively low pressures usually considered for the purpose of purifying oxygen or nitrogen. Furthermore, oxygen and argon are largely adsorbed at chemically identical sites on the NaX pore walls and also have similar adsorption isotherms, while nitrogen is largely adsorbed at distinct sites which do not overlap with those of oxygen and argon. Because of these facts, we may simplify our analysis by treating the argon fraction of air as if it were oxygen in the following without making any errors large enough to invalidate the principles that an AE-CAES embodiment is intended to exemplify. Furthermore, the above observations together with experimental data presented by E. A. Ustinov (Russ. J. Chem. 81, 246, 2007) show that we may assume that the amount of nitrogen adsorbed is independent of the amount of oxygen (and argon) adsorbed, and vice versa.

Complete isotherms for nitrogen, oxygen (and argon) adsorption to NaX have been measured at pressures of up to about 4 atmospheres and at four widely separated temperatures between −70 and 50° C. (see G. W. Miller, AIChE Symp. Ser. 83, 28, 1987). The values of the parameters in the Sips and Langmuir isotherm equations, as determined by fitting these data, were also given in that paper, and may be used to extrapolate these measurements to higher pressures.

FIG. 1 plots adsorption isotherms for the principal constituents of air, namely nitrogen and oxygen, with the commercially available zeolite widely known as NaX or 13X, at four different temperatures and at pressures of up to 20 atmospheres. The isotherms for nitrogen, obtained from the Sips isotherm formula, are plotted with solid lines, while those for oxygen are obtained from the Langmuir isotherm, a special case of the Sips, and are plotted with dashed lines. The plots shown thus extrapolate Miller's data to the higher pressures needed for a cost-effective adsorption-enhanced compressed air energy storage device.

Figure 2:
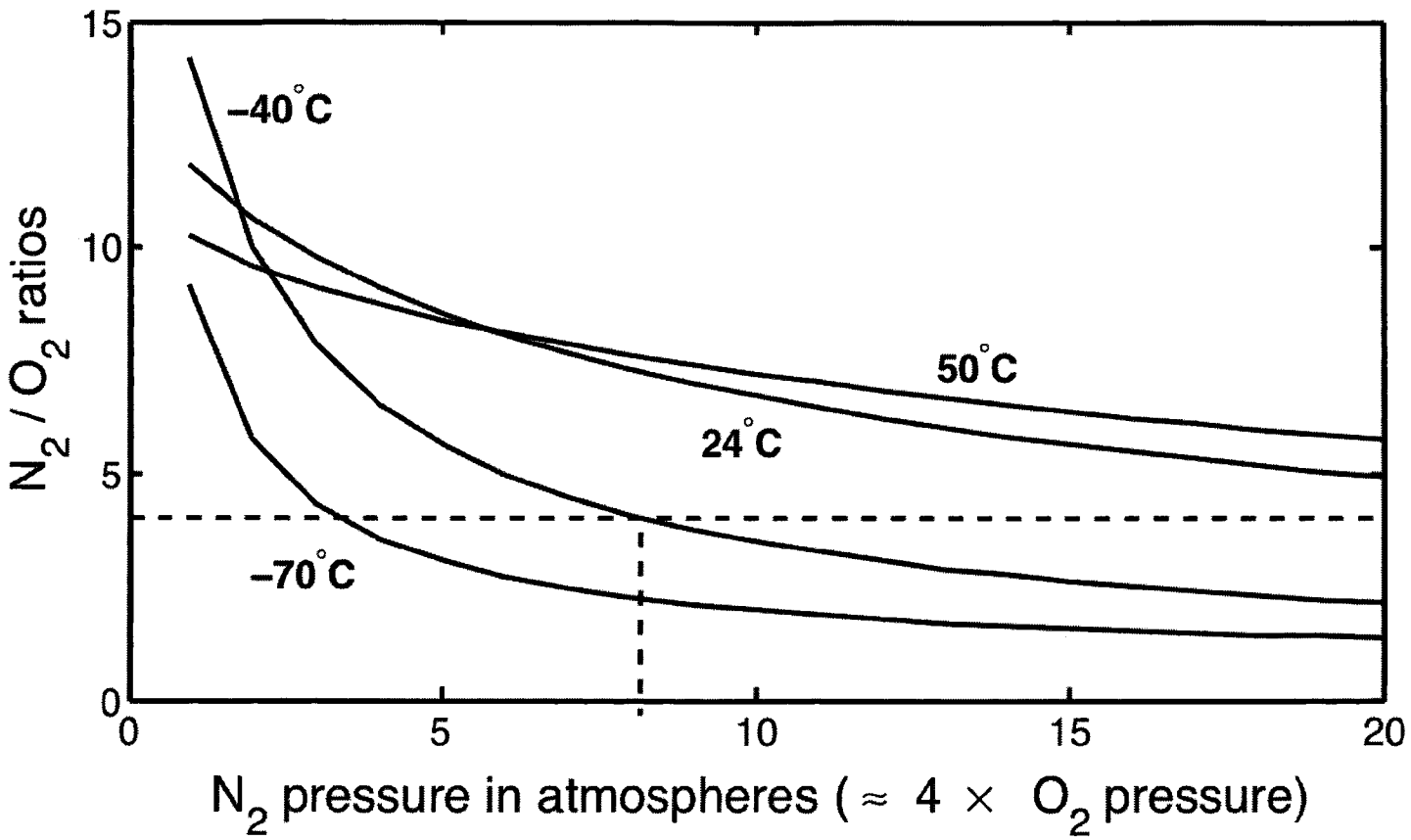
FIG. 2 plots the ratio of the number of nitrogen to the number of oxygen molecules versus nitrogen pressure where the ratio of nitrogen to oxygen pressures has a fixed value of 4.0.

FIG. 2 plots the ratio of the number of nitrogen molecules to the number of oxygen molecules adsorbed to NaX against pressure at the same four temperatures as in FIG. 1, where the pressure of oxygen at each point on the plot is 25% that of nitrogen and hence approximately equal to the partial pressure of oxygen in air at 125% of the nitrogen pressure. These ratios are calculated using the extrapolated isotherms shown in FIG. 1. The dashed horizontal line shows where this ratio has the value 4.0, so that the ratio adsorbed is approximately equal to the ratio of the partial pressures of nitrogen and oxygen in air. The corresponding pressure at a temperature of −40° C., indicated by the dashed vertical line, is expected to be a reasonably cost-effective nitrogen partial pressure for an embodiment of adsorption-enhanced compressed air energy storage based on a temperature-swing cycle with a minimum temperature of −40° C. This is because going to higher pressures or lower temperatures would increase the amount of air adsorbed at a lower rate than had been achieved at lower pressures and higher temperatures, so that the cost-benefit ratio obtained from the use of the NaX adsorbent would become less favorable.

FIGS. 3 through 8 show schematic diagrams of the complete AE-CAES (adsorption-enhanced compressed air energy storage) embodiment. These diagrams are graphic versions of the well-known process flow diagrams and the associated symbols for the common mechanical, fluidic and electrical components of chemical and materials processing systems, which are widely used by the engineering community. Process flow diagrams are not intended as blue-prints for a specific design, but rather to allow one skilled in the art of chemical and materials processing to design a system that can reproduce a specific process using such standard components. The diagrams thus provide a suitable means of describing the invention, which provides processes by which CAES systems may be enhanced using adsorption in porous materials, rather than a specific device or design. In those parts of the embodiment in which the components employed are not perfectly standard, more detailed drawings are given, and these have been enlarged in FIGS. 9 through 11.

Figure 3:
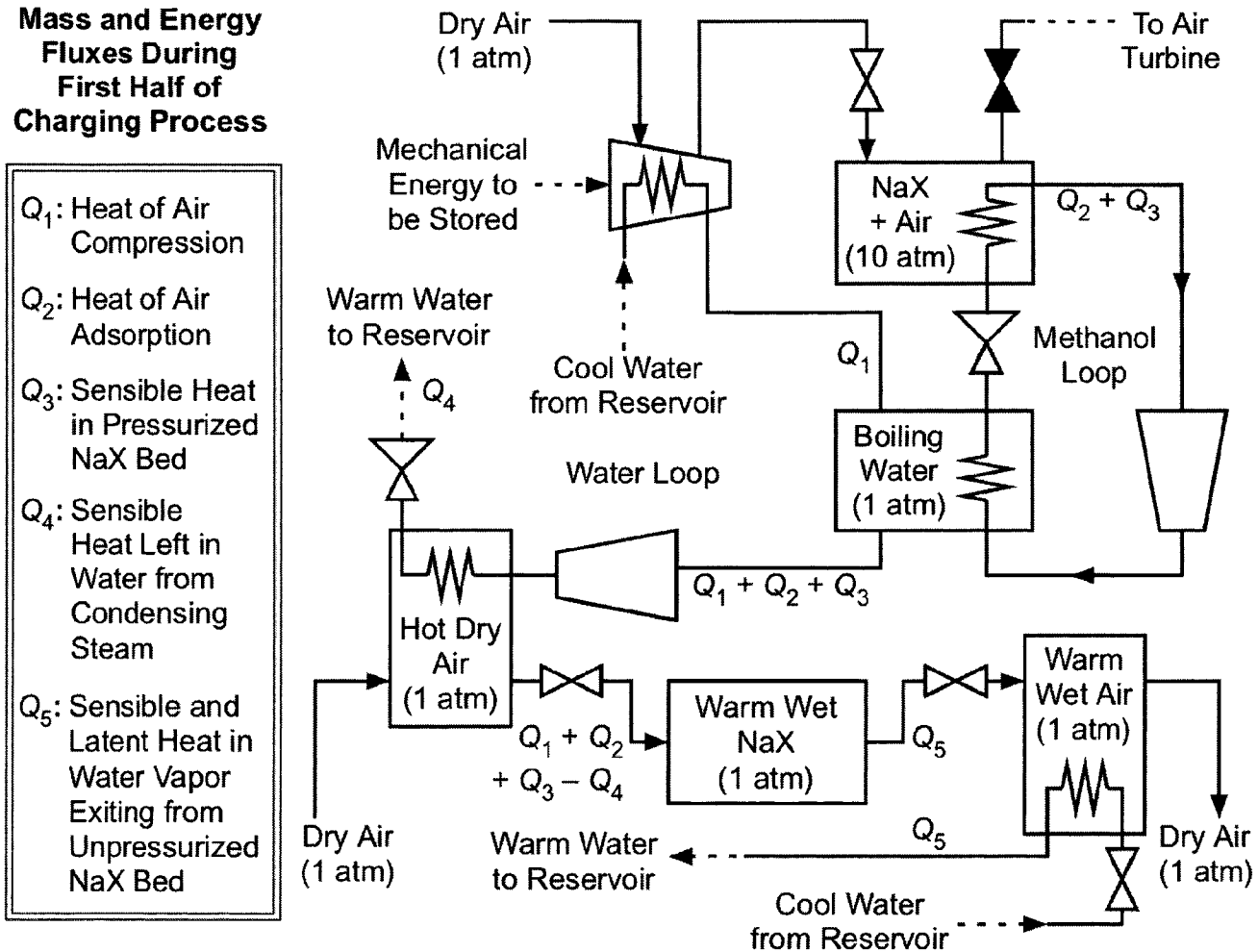
FIG. 3 is a schematic diagram of mass and energy flow in an adsorption-enhanced compressed air energy storage embodiment, showing these flows during the first half of the charging process.
Figure 4:
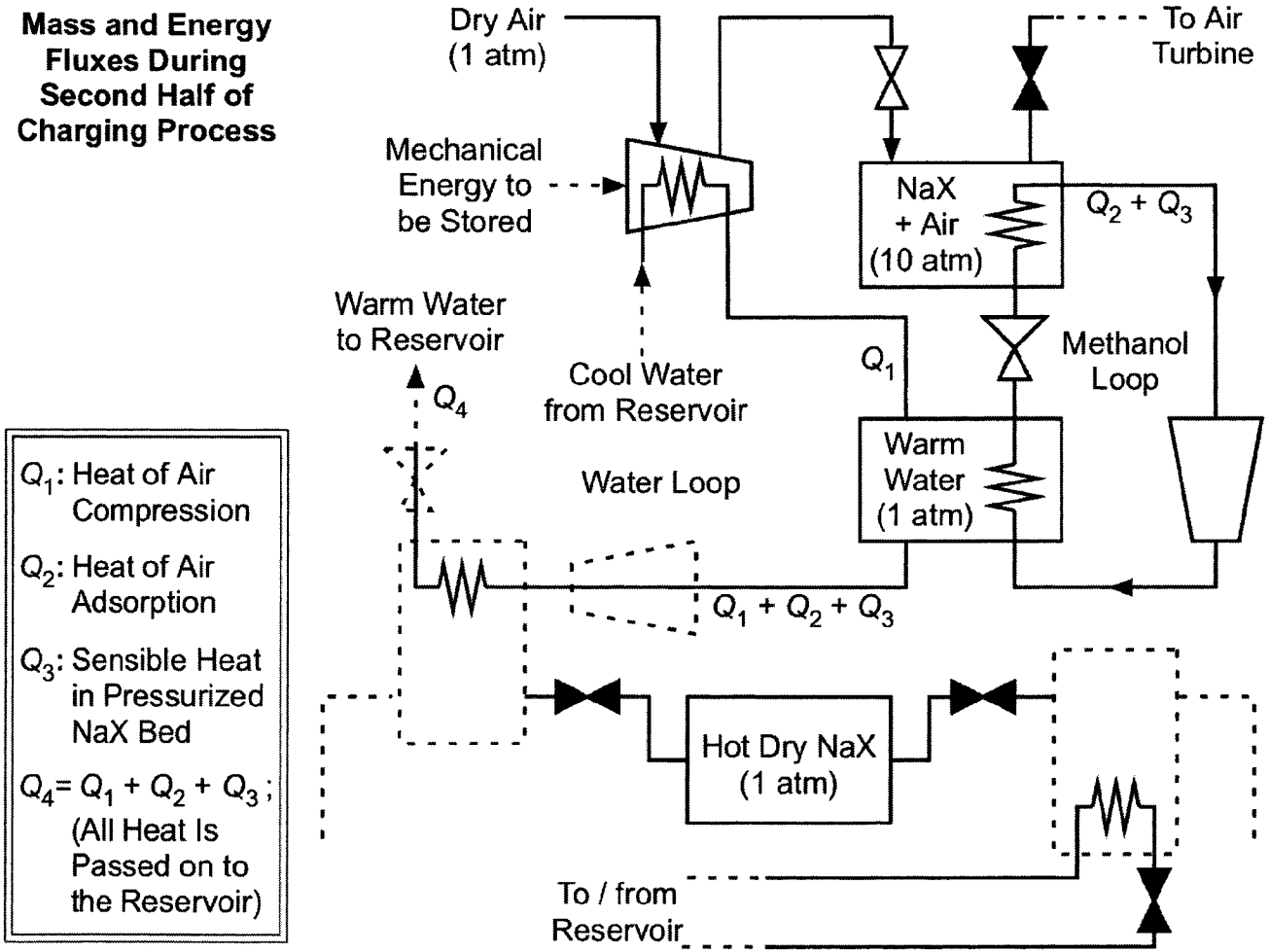
FIG. 4 is a schematic diagram of mass and energy flow in an adsorption-enhanced compressed air energy storage embodiment, showing these flows during the second half of the charging process.
Figure 5:
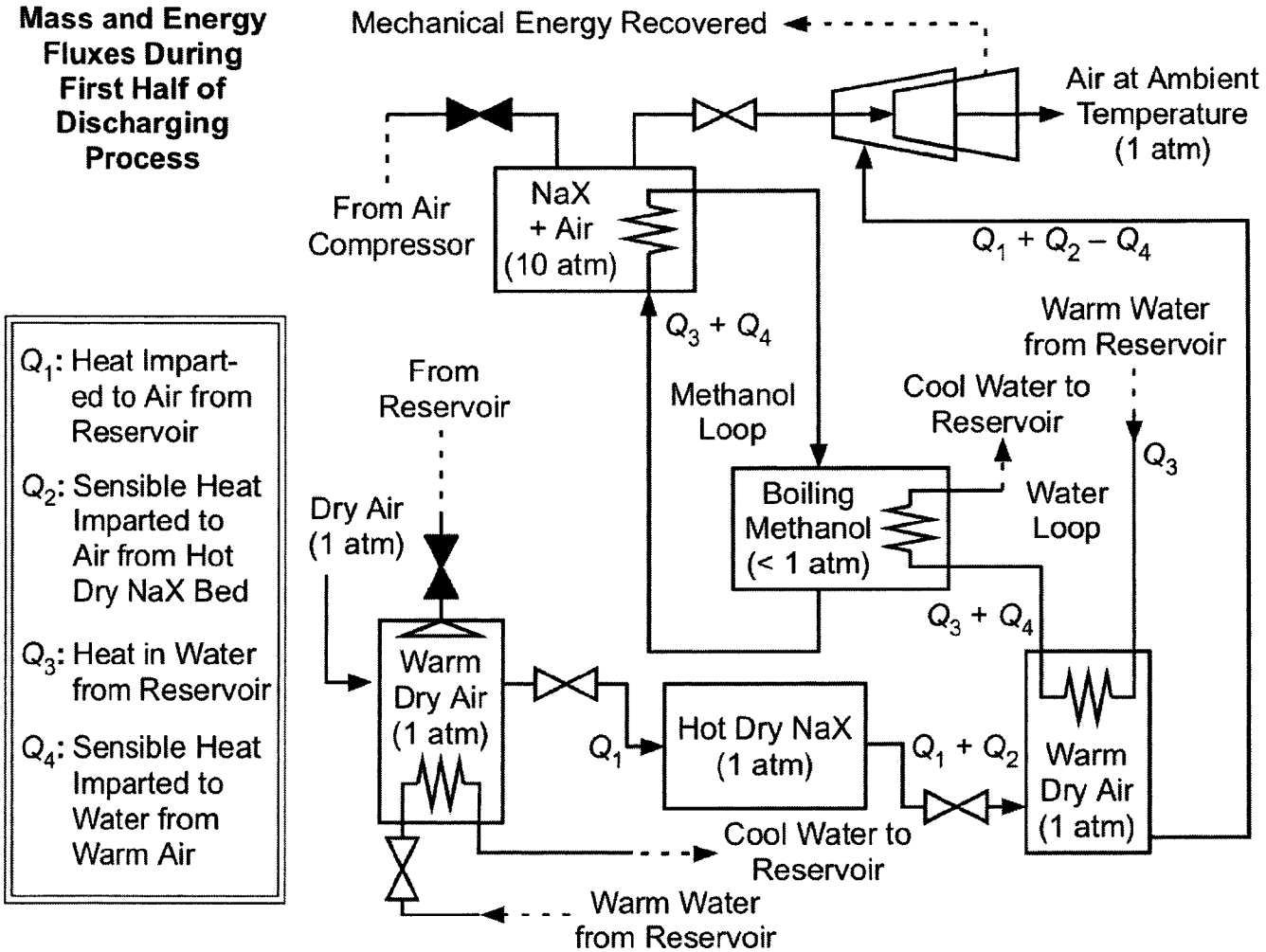
FIG. 5 is a schematic diagram of mass and energy flow in an adsorption-enhanced compressed air energy storage embodiment, showing these flows during the first half of the discharging process.
Figure 6:
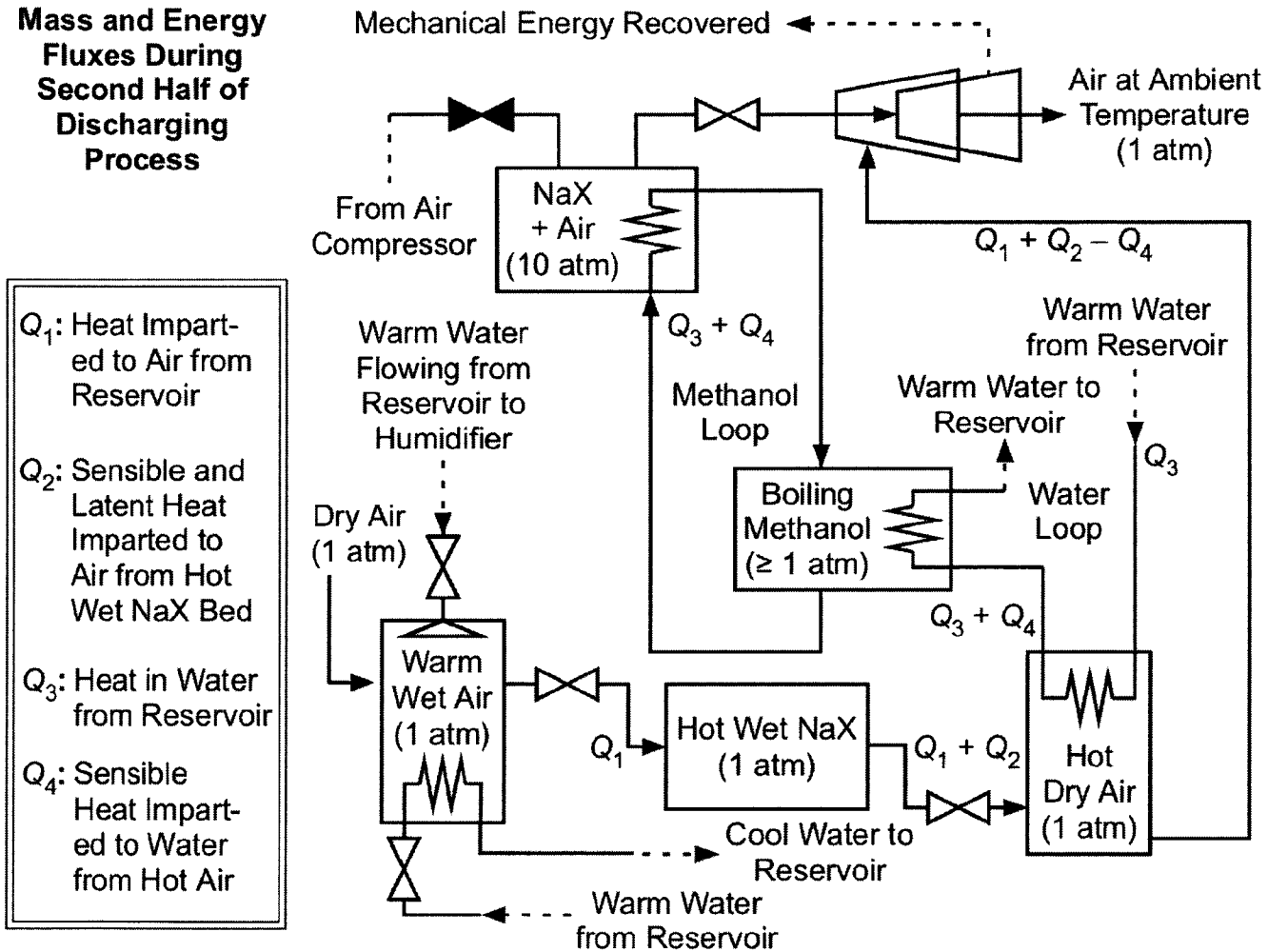
FIG. 6 is a schematic diagram of mass and energy flow in an adsorption-enhanced compressed air energy storage embodiment, showing these flows during the second half of the discharging process.

FIGS. 3 through 6 give high-level views of the principal mass and energy fluxes through an exemplary embodiment of an AE-CAES system at four points in its charge-discharge cycle. FIG. 3 shows these fluxes at the beginning of the charging process, when the pressurized NaX bed 1 is near 100° C. and so has the minimum quantity of air adsorbed to it, while the unpressurized NaX bed 41 is largely saturated with water. FIG. 4 shows how the fluxes are altered about halfway through the charging process, when the temperature of the pressurized NaX bed 1 has fallen to the prevailing ambient air temperature and the unpressurized NaX bed 41 is has lost most of its water. FIG. 5 shows the fluxes at the beginning of the discharging process, when the pressurized NaX bed 1 is at −40° C. and so has the maximum amount of air adsorbed to it, while the unpressurized NaX bed 41 is still hot and dry. FIG. 6 shows how these fluxes are altered about halfway through the discharging process, when the temperature of the pressurized NaX bed 1 is approaching the ambient air temperature and water vapor is now being carried into the unpressurized NaX bed 41 to produce the heat needed for complete discharge.

Figure 7:
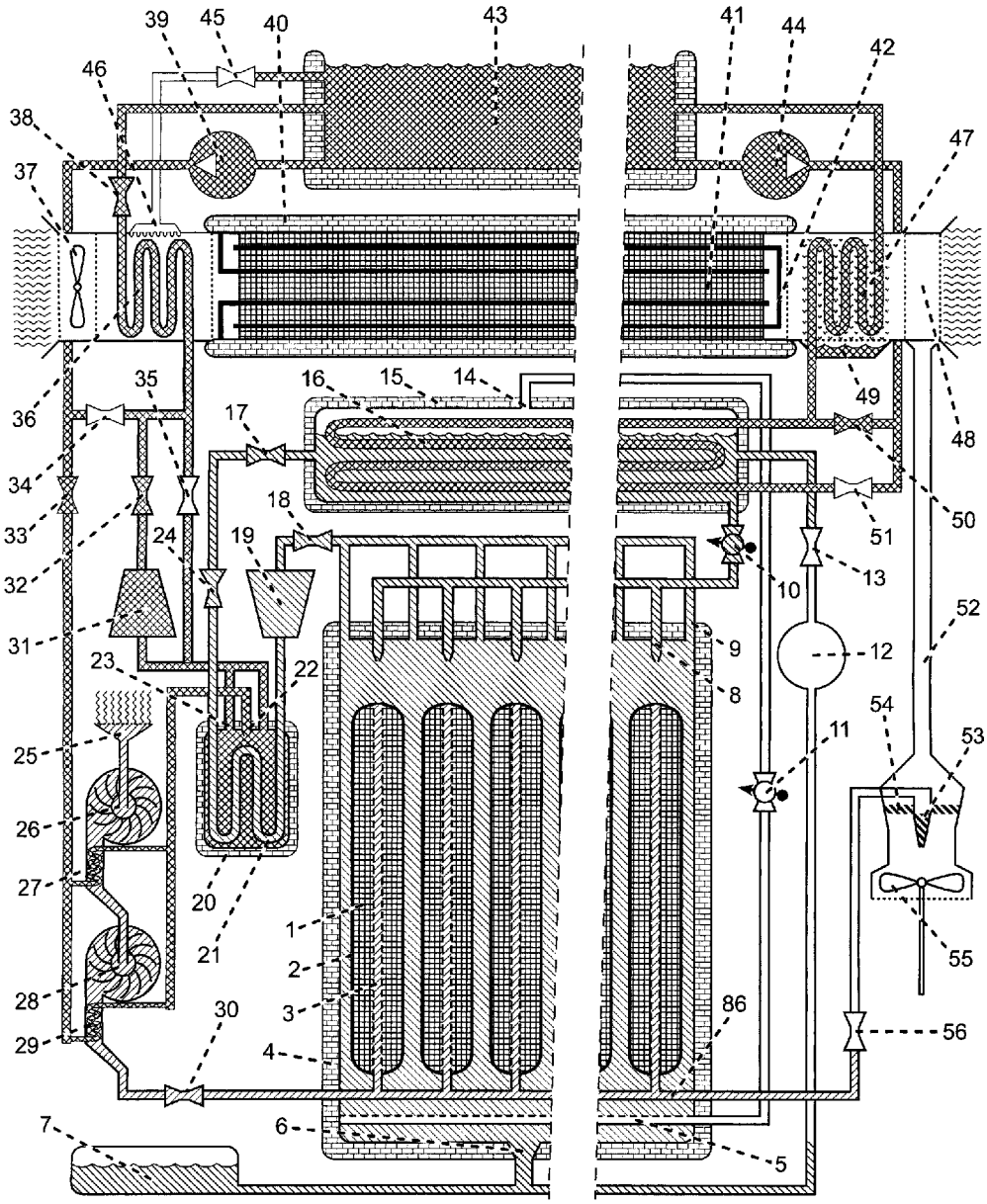
FIG. 7 is a process flow diagram which illustrates in greater detail how an adsorption-enhanced compressed air energy storage embodiment operates during the first half of the charging process.
Figure 8:
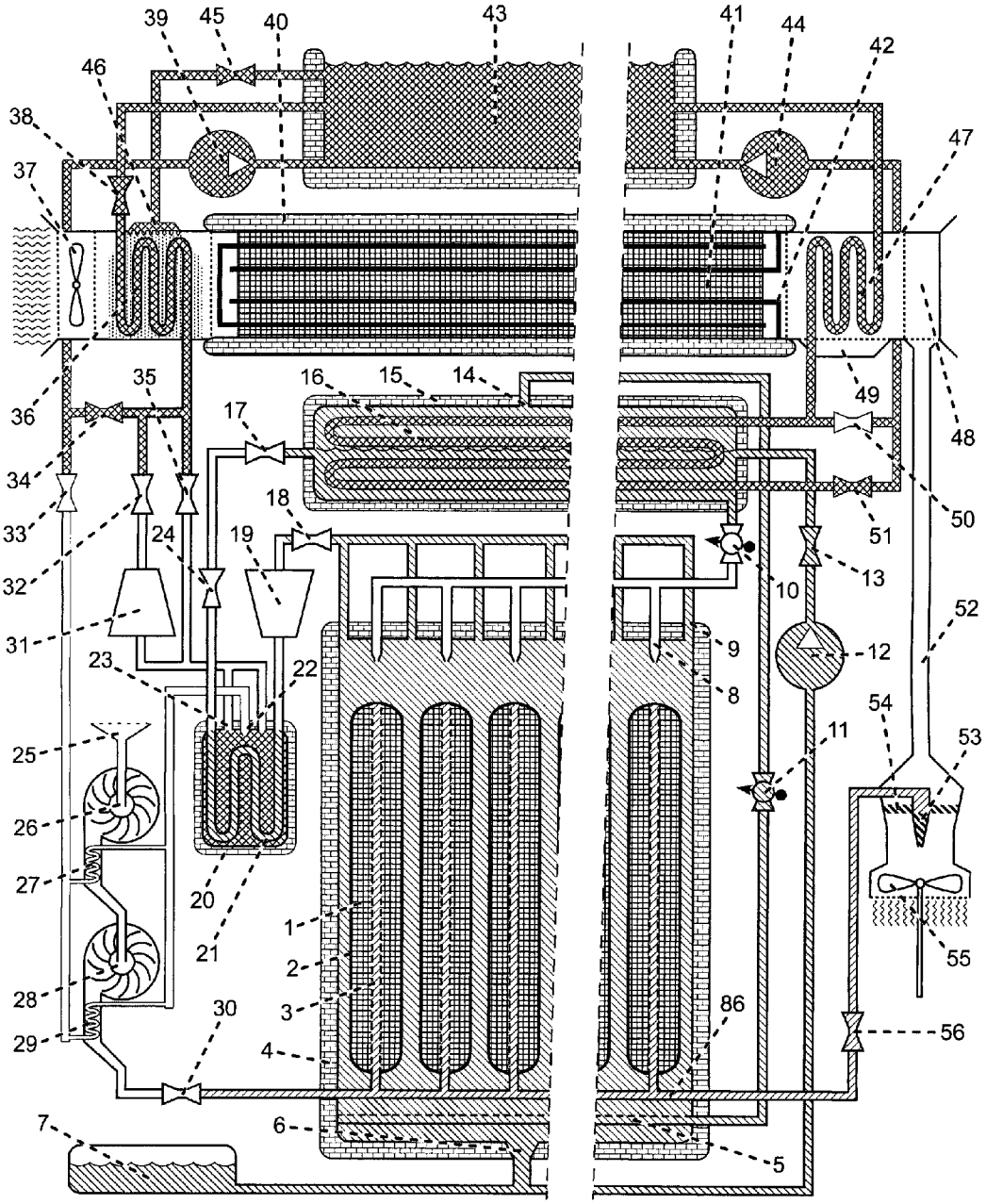
FIG. 8 is a process flow diagram which illustrates in greater detail how an adsorption-enhanced compressed air energy storage embodiment operates during the second half of the discharging process.
Figure 9:
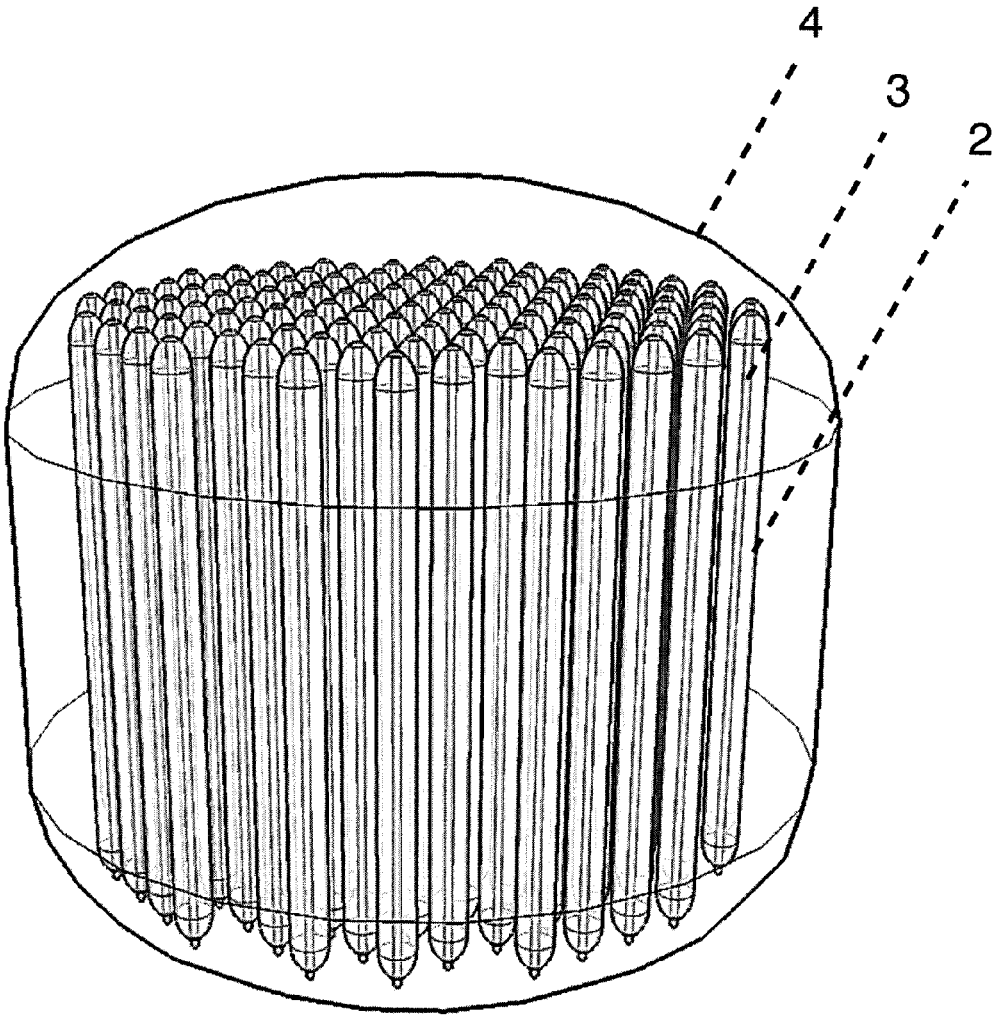
FIG. 9 is a set of four three-dimensional drawings of an array of air adsorption cylinders in a temperature-control chamber labeled as 9A-9D respectively.
Figure 9A:
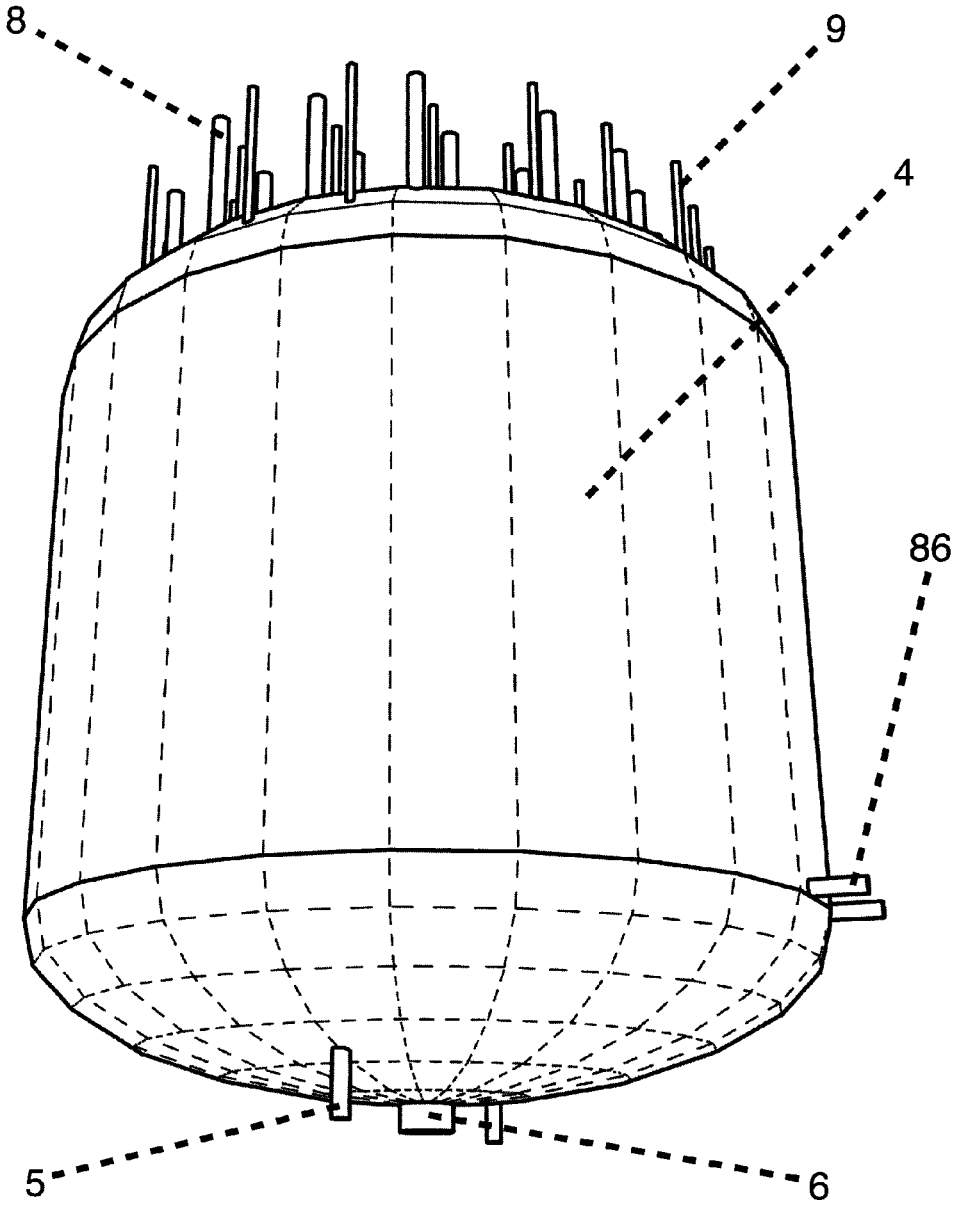
Figure 9B:
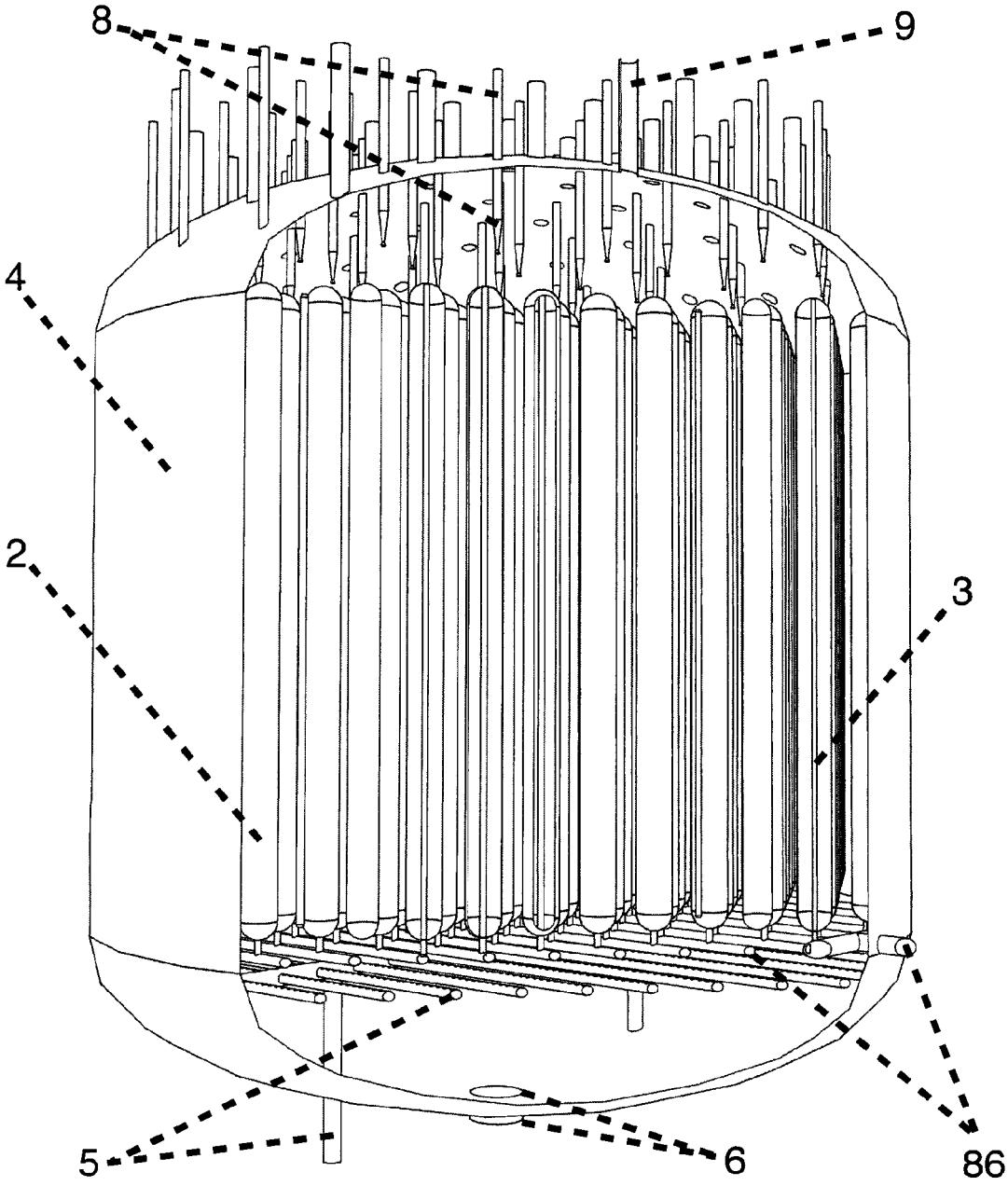
Figure 9C:
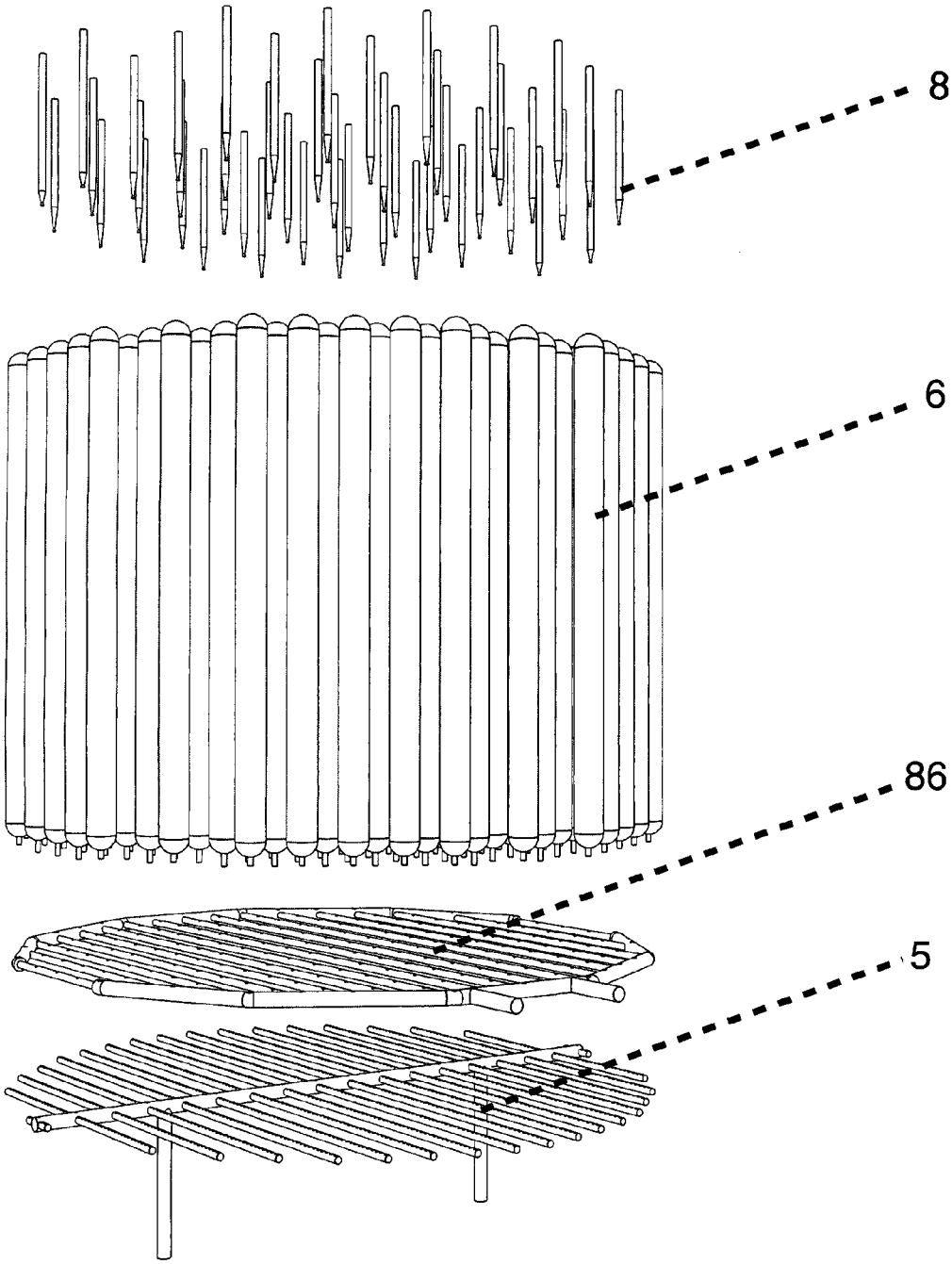
Figure 9D:
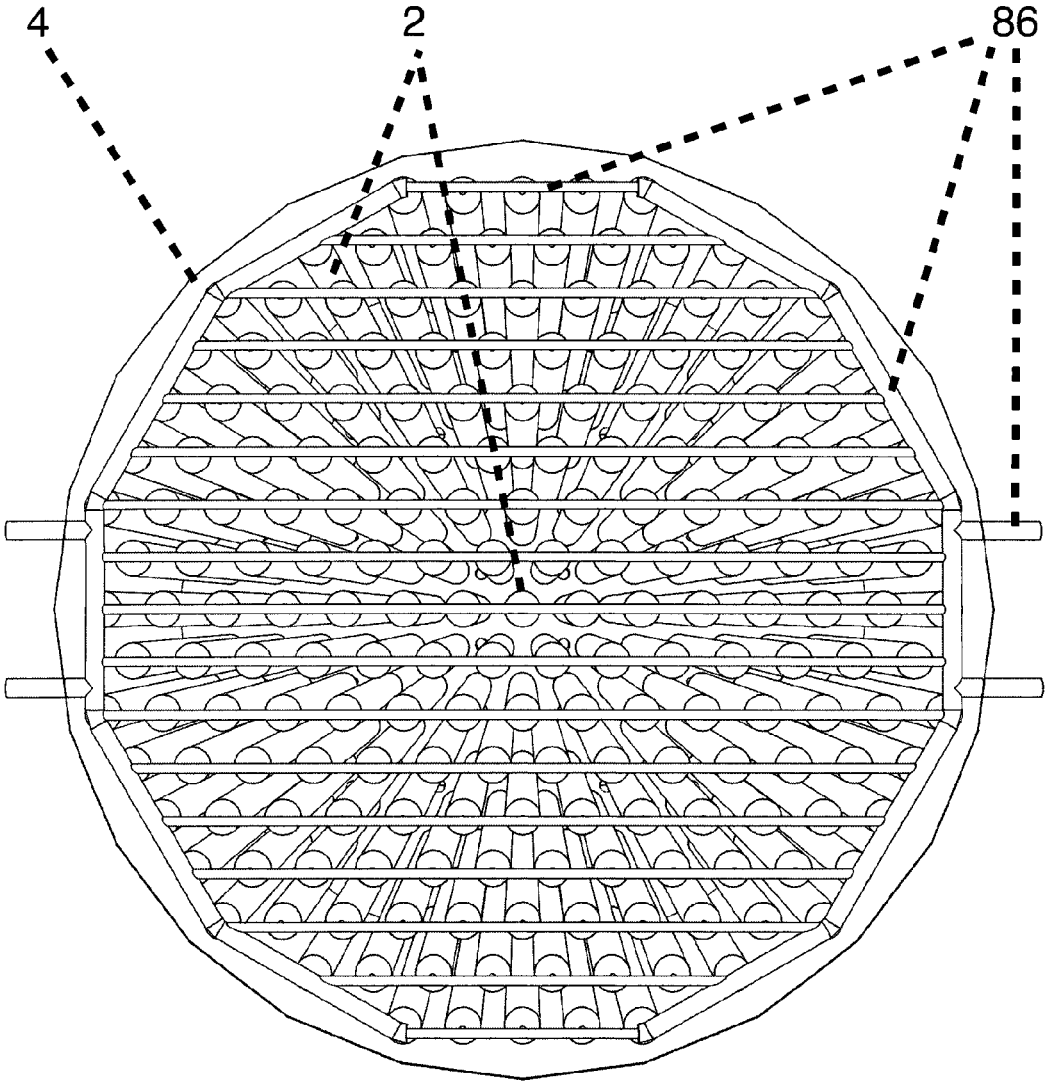
Figure 10:
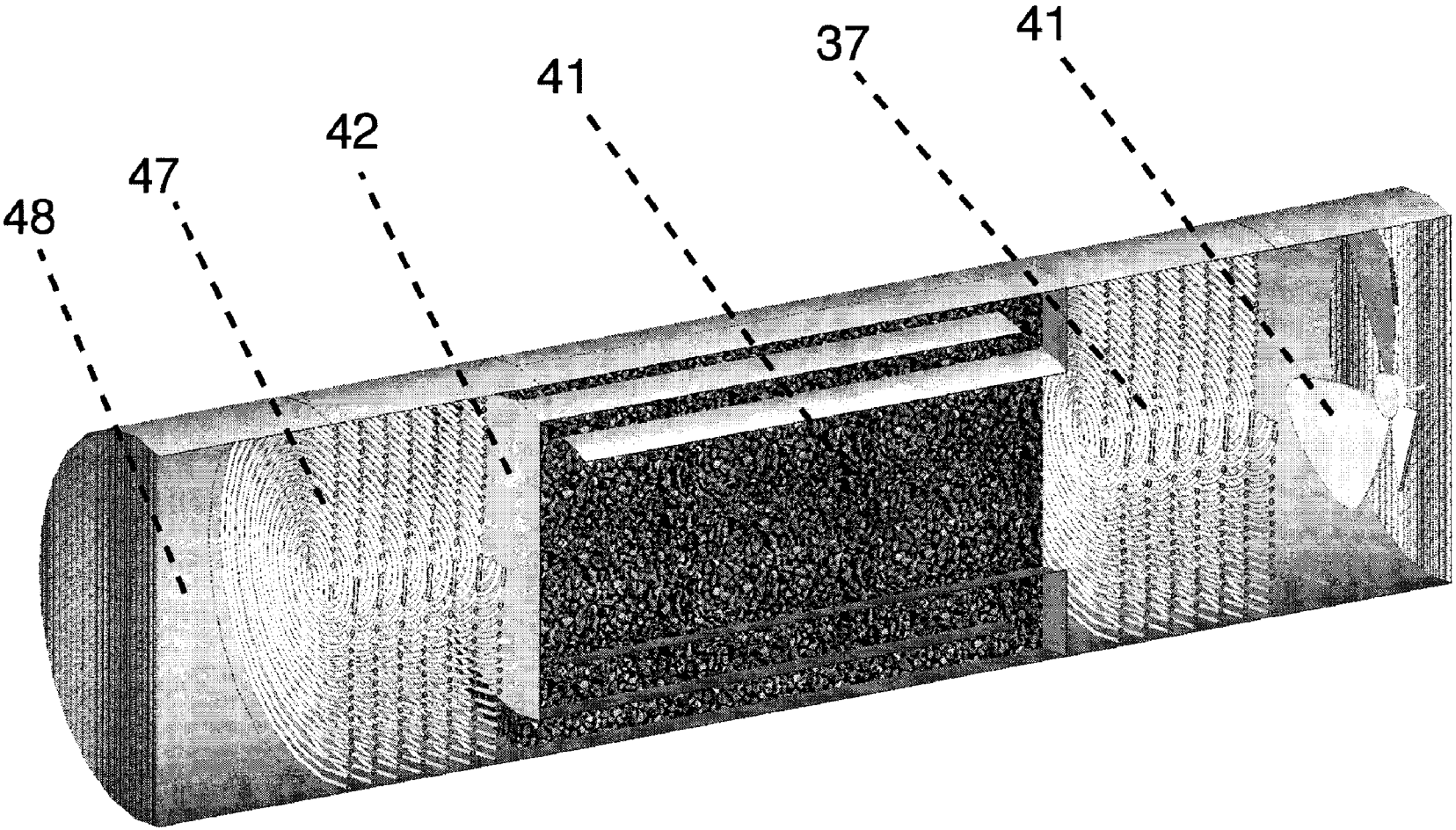
FIG. 10 is a three-dimensional drawing of the adsorption heat pump that is primed and used to upgrade stored heat during the first half of the charging and second half of the discharging processes, respectively.
Figure 11:
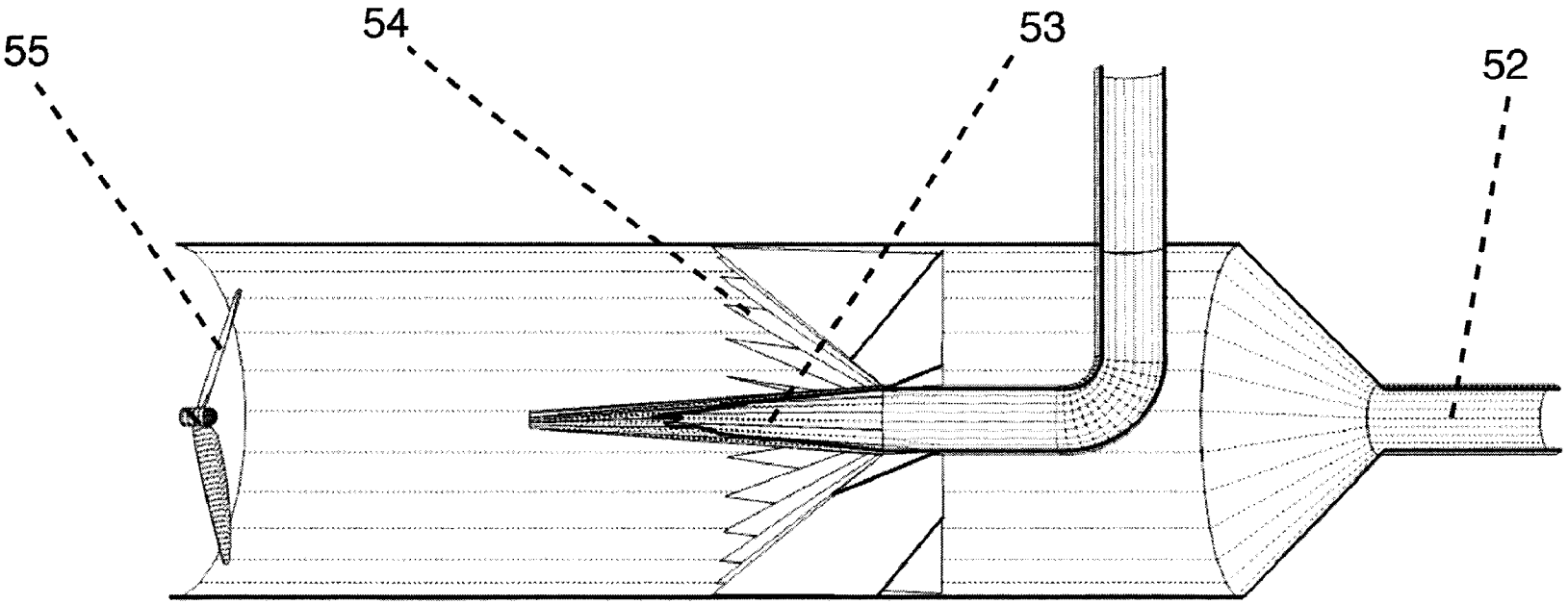
FIG. 11 is a three-dimensional drawing of the mixer-ejector air turbine used to recover the energy stored as compressed air, adsorbed air, and heat during the discharging process.

FIG. 7 shows a more detailed view of an AE-CAES embodiment in the beginning of the process of being charged with energy (cf. FIG. 3), when the unpressurized NaX bed 41 of the adsorption heat pump is being heated to drive off the adsorbed water. FIG. 8 shows the same embodiment following the halfway point of the discharging process (cf. FIG. 6), when water vapor is being passed through the unpressurized NaX bed 41 to generate the high temperatures needed for full discharge. FIG. 9 shows four three-dimensional views of a compressed air storage module, which contains cylinders 2 ready to be packed with zeolite pellets 1, within the condensation/vaporization chamber 4 used to control the temperature. FIG. 9A is a view of the exterior of the module. FIG. 9B is a cutaway view through its side. FIG. 9C is an exploded view of the interior of the module without the temperature-control chamber, and FIG. 9D is a cutaway view through the bottom just below the manifold 86 which brings air to and from the cylinders 2. FIG. 10 shows an enlargement of the adsorption heat pump 40 containing the zeolite bed 41 used to store the heat generated by the compression and adsorption of air, including the baffles 42 used to ensure that the atmospheric air, which carries water vapor out of it during charging, roughly reverses the flow of the air, which carries water vapor into it during discharging, for maximum efficiency. FIG. 11 shows an enlargement of the mixer/ejector air turbine, including the components labeled 53, 54 and 55, used to efficiently convert both the energy stored as pressure and as heat back into mechanical energy during the discharging process.

The foregoing assumptions, together with extrapolations graphed in FIG. 1, imply that at −40° C. and 10 atmospheres the ratio of the quantities of nitrogen to oxygen adsorbed will be about 4 (FIG. 2). Since this is also about the ratio of the partial pressures of nitrogen to oxygen in air and NaX is largely saturated by nitrogen at this temperature and 8 atmospheres, the amount of air adsorbed should not increase greatly at higher pressures or lower temperatures. An AE-CAES embodiment thus utilizes a working pressure of 10 atmospheres and a minimum temperature, obtained when the device is fully charged with energy, of −40° C.

Similarly, the approximations and the extrapolations shown in FIG. 1 imply that at 10 atmospheres and 24° C., about 34.5% of the nitrogen and 74.5% oxygen adsorbed at −40° C. has been desorbed, while at 50° C. these percentages are 53.5% and 82.5% respectively. Thus if one goes up to 100° C. at 10 atmospheres, at least 75% of nitrogen and essentially all of the oxygen will have been desorbed. This in turn implies that at least 80% of the total air that is adsorbed at −40° C. will be desorbed at 100° C. Because going beyond 100° C. would make the device more complicated and expensive, an AE-CAES embodiment utilizes a maximum temperature, attained when the device is fully discharged, of 100° C., which as just argued implies a duty cycle of at least 80% in AE-CAES embodiment.

Under dry air at −40° C. and 10 atmospheres, our approximations and the extrapolated isotherms further indicate that NaX will have adsorbed 4.24 and 1.14 moles of nitrogen and oxygen, respectively, per kilogram of anhydrous crystalline NaX. With a molar volume for ambient air of 24.8 liters and a density for crystalline NaX of 1.53 Kgr/L (Kgr/L=Kilogram/Liter), this implies about 204 L of ambient air will be adsorbed per liter of NaX under these conditions. This is about 160 L of air at −40° C. and one atmosphere, or 16.0 L for air at this temperature and 10 atmospheres.

Rather than working with a microcrystalline powder, however, it is necessary to form the NaX into pellets that will allow air to flow readily through the zeolite beds used in the device, by means of a thermally conducting binder that will also enable rapid heat transfer through the beds. Typically these pellets are about 20% by volume of the binder, and can be packed with a density of about 80% by volume, thus reducing the volume of air adsorbed at the working pressure and minimum temperature to about $0.8^2 \times 16.0 = 10.25$ L per liter of NaX pellets. Taking the 20% void fraction into account, at equilibrium the total quantity of air in a tank packed with a bed of NaX pellets and filled with air at −40° C. and 10 atmospheres will thus be 10.45 times the amount that could be stored in the same tank at the same temperature and pressure. Together with the 80% duty cycle conservatively estimated above, this gives us an 8.35 fold reduction in the amount of structural material needed to make a tank that can store and release a given quantity of air at the working pressure and minimum temperature of an AE-CAES embodiment.

The foregoing calculations show that when fully charged each cubic meter of the NaX pellet bed in an AE-CAES embodiment will store about 133 cubic meters of ambient air. Assuming that we perfectly store and recover the heat while operating the device, but assuming once again an 80% duty cycle, the work needed to isothermally compress this much air to 10 atmospheres comes out to 24.5 MJ/$M^3$, or 6.8 kilowatt-hours in each cubic meter of the bed. The volumetric energy density of the zeolite pellet bed in an AE-CAES embodiment is thus about one tenth that of typical lead acid batteries. The efficiency with which this energy can be recovered in practice is discussed in what follows.

Before moving on to discuss the rest of an AE-CAES embodiment, we will estimate the heat released by the adsorption of air to the NaX bed, as well as the amount of heat that must be taken from it simply to lower its temperature by 140° C. Miller (loc. cit.) has estimated that the heat of adsorption of nitrogen to NaX over the range of loadings utilized in an embodiment is 18.87 KJ/(mol K), while that of oxygen is about 13.09 KJ/(mol K). It follows that the energy released on adsorbing 4.24 moles of nitrogen and 1.14 moles of oxygen is 94.9 KJ (KJ=Kilo-Joules). Taking into account the reductions due to our use of a packed bed of NaX pellets and assuming an 80% duty cycle as before, this comes out to about 48.6 MJ (Mega-Joules) or 13.5 KWHr/$M^3$ (Kilo-Watt-Hours per cubic Meter). This is about twice the amount of energy that could be stored and recovered per cubic meter. Although E. A. Ustinov (loc. cit.) found a slightly lower heat of adsorption oxygen to NaX and also some fall off in that of nitrogen at 10 atmospheres, it is clear that the most of the heat of adsorption must be stored and recovered in any reasonable efficient embodiment of AE-CAES.

The heat of adsorption, however, will be considerably smaller than the sensible heat needed to cool and reheat the NaX bed itself over the 140° C. temperature swing. The specific heat capacity of the bed will vary with the how the pellets are prepared and to some extent with temperature but is typically of order 1 KJ/(Kgr K), which together with the above assumptions concerning the pellets' packing density implies a volumetric heat capacity of about 1 MJ/($M^3$ K). Multiplying this by 140 and converting to kilowatt-hours gives 38.9, which is much larger than the energy to be stored and recovered per cubic meter. Fortunately, as we shall see, the relatively high-grade heat needed to raise the temperature of the NaX bed from ambient to 100° C. is easily recovered, and it is of course not necessary to keep the temperature high once the air has been removed from the pressure chamber and the valve leading into it has been closed. Similarly, the relatively low-grade heat that must be removed to take the temperature of the bed from ambient down to −40° C. does not need to be stored and recovered, since that heat can readily be obtained from the environment while discharging the device. We now turn to the mechanisms used in an AE-CAES embodiment to accomplish all of the above tasks.

Referring now to the schematic diagrams shown in FIGS. 7 and 8, we first point out that the parallel dashed lines separated by white space which cut the diagrams in two are meant to indicate that the scale of the device is somewhat arbitrary, and will be determined in practice largely by how it is transported to its site and utilized. Purely for the sake of discussion, however, we will often use one megawatt-hour as amount of energy stored per module in what follows. This would require about 145 $M^3$ of NaX pellets (horizontal-vertical cross-hatching in the diagrams.

As may be seen in the drawing of FIG. 9, the NaX zeolite pellets 1 of an AE-CAE embodiment are packed into cylinders 2, with a perforated hollow tube 3 extending from a hole at the bottom of each cylinder all the way to the other end of the cylinder. This tube allows the compressed air (left-to-right upwards-slanted hatching in the diagrams) to pass rapidly from the vent at the bottom of the cylinder through its entire length when charging the AE-CAES device, and back out again when discharging it. As a result, the length of the cylinders is not critical, but their diameters should be small enough to allow the rapid diffusion of air from the holes in the tube 3 through the NaX bed 1 to the surface of the cylinder 2, as well as the rapid diffusion of the heat generated as the air is adsorbed.

Primarily because they are mass produced and hence available for a low cost, an AE-CAES embodiment uses cylinders similar to, but longer than, the aluminum cans in which beverages like Coca Cola® are commonly packaged. Aluminum is more costly than steel, but is more easily formed into such cylinders, more corrosion resistant and has a higher thermal conductivity, although slightly thicker walls than those of typical aluminum cans will be needed in order to contain ten atmospheres of pressure. As such, the diameter of the cylinders 2 in an embodiment will be 6.0 centimeters, while the perforated tubes 3 down their centers need be no more than 0.5 centimeters in inner diameter and are made from steel in order to provide structural support to the packed cylinders. The distance through which air and heat must diffuse in order to reach the surface of the cylinders is thus only about 2.75 centimeters. Of course neither the exact dimensions of the cylinders, the material of which they are made, nor even a cylindrical form for the pressure vessels that contain the bed of pellets of NaX or other porous material is essential to the invention.

The cylinders 2 in turn are contained in a chamber with thermally insulated walls 4 that can withstand modest pressures and be evacuated over the temperature swing of an AE-CAES embodiment. This chamber serves to contain a heat transfer fluid, which in turn is used to control the temperature of the compressed air and NaX bed 1 inside the cylinders 2 and so implement the temperature-swing cycle utilized. Neither the geometry of the chamber nor the way in which the cylinders 2 are arranged within it are critical, but for the sake of economy the packing should be as dense as possible while allowing the heat transfer fluid to flow freely around the cylinders. In FIG. 9 a temperature-control chamber 1.25 M in diameter is shown, which contains 108 cylinders each 1.0 M long and arranged on a square grid with its points 0.1 M apart, for a total of about 0.21 $M^3$ of NaX bed per chamber. Six hundred ninety such chambers would be needed to store a megawatt-hour of energy.

In this AE-CAES embodiment, the fluid that carries heat to and from the chamber with walls 4 is methanol. This is a liquid at ambient pressures and −40° C., the lowest temperature reached over the temperature-swing cycle, while it is a gas at ambient pressures and 100° C., the highest temperature reached. It also has a high heat of vaporization, averaging about 36 kJ/mole over this temperature range, and its exact boiling point can be set to any value between −40 and 100° C. by controlling the pressure in the chamber with walls 4. Specifically, the boiling point of methanol at a pressure of one atmosphere is 64.7° C., and if we assume that its heat of vaporization does not depend on pressure, we may use the Clausius-Clapyron equation to show that its boiling point will be 100° C. at 3.6 atmospheres and −40° C. at 231.5 Pascal (about 0.2% of an atmosphere). These modest temperatures and pressures allow the walls 4 of the chamber to be made out of an inexpensive fiberglass composite formed from a heat-resistant phenolic) resin or epoxy, which will also provide some of the requisite thermal insulation. Of course other embodiments are possible in which fluids besides methanol are utilized to transfer the heat, and/or other materials are used for the walls 4 of the chamber.

When charging an AE-CAES embodiment, liquid methanol (heavier left-to-right downwards-slanted hatching) is sucked from a hermetically sealed and thermally insulated tank 15 through the control valve 10 and sprayed at a programmed rate from nozzles 8 in the top of the chamber with walls 4, as indicated in FIG. 7. A portion of this methanol vaporizes and exits the chamber through vents 9 interspersed with the nozzles while the remaining liquid methanol, now at its boiling point for the pressure in the chamber, flows down the sides of the cylinders 2 and boils off of them as it does so, thereby cooling them along with the NaX beds 1 which they contain. The additional methanol vapor (lighter left-to-right downwards-slanted hatching) generated by this process rises and exits the chamber through the vents 9 as before, while any liquid methanol that makes it to the bottom of the chamber flows into a drain 6 in the bottom and thence back to a small sealed holding tank 7 for reuse.

In contrast, when discharging an AE-CAES embodiment, the valve 10 is closed, another control valve 11 opened, and the methanol in the storage tank 15 is heated by the passage of hot water (heavier diagonal cross-hatching in the diagrams) through a heat exchanger 16 inside the tank. The resulting methanol vapor exits the tank 15 through a vent 14 in its top and flows through a pipe that leads to a network of perforated tubes 5 at the bottom of the chamber with walls 4. The methanol vapor then rises and condenses on the surfaces of the cylinders 2, transferring its heat of vaporization to them at the temperature determined by the prevailing pressure in the chamber. This in turn increases the temperature of the NaX bed 1 towards its desired value, while the condensed liquid methanol again flows out of the chamber through the drain 6 and into the holding tank 7. A simple positive-displacement pump 12 then returns it to the tank 15 via the now-open valve 13 for reuse, as indicated in FIG. 8.

While charging an AE-CAES embodiment, the pressure in the chamber with walls 4 is reduced via a compressor 19 into which the methanol vapor flows from the vents 9 through the valve 18, as indicated in FIG. 7. It exits the compressor 19 at a high pressure and temperature, and flows into a heat exchanger 21 in a thermally insulated tank 20, where it is cooled by a stream of water at ambient pressure to a temperature of about 100° C. The methanol vapor then passes through the pressure-reducing valve 24, which allows it to expand, further cool and largely condense, and from there back through the open valve 17 to the storage tank 15 for reuse. In this way, the heat generated by adsorption of the air to the NaX bed 1 is transferred to the water or steam (diagonal cross-hatching in the diagrams) passing through the tank 20. Many kinds of compressors could be used for 19, with the exact choice to be determined mainly on economic grounds, in accord with the following technical considerations.

For efficient heat transfer to boiling water, the compressed methanol vapor should have a temperature well above that, say 150° C. With an adiabatic index for methanol of 1.3 it follows that early in the charging process, when the methanol vapor enters the compressor 19 with a pressure of 3.6 atmospheres and a temperature of 100° C., it will only need to increase the pressure by a factor of about 1.7, or to 6.2 atmospheres. Late in the charging process, however, as the pressure and temperature in the chamber with walls 4 fall to 231.5 Pascal and to −40° C., respectively, it would need to increase the methanol vapor pressure by a factor of almost 13.3, resulting in a pressure that is still only 0.03 atmosphere. The Carnot limit on the coefficient of performance of this cooling system is infinite at the beginning when the temperature in the chamber with walls 4 is 100° C., but only 1.66 at the end of the charging process when it has fallen to −40'C. In accord with our earlier discussion of the large quantity of sensible heat that must also be removed from the NaX beds 1 during charging, once the theoretical coefficient of performance falls below about 3, which happens when the NaX bed temperature reaches 7° C., it will no longer be profitable to try to store this heat, nor the smaller amount of heat released by adsorption, in a form that can subsequently be used to generate high temperatures. This issue will be taken up again presently (cf. FIGS. 3 and 4).

Before describing where the heat goes next, we first consider the process by which the air is compressed to ten atmospheres when charging an AE-CAES embodiment, and at the same time much of the heat of compression is removed from it. Due to their high efficiency, in the AE-CAES embodiment this is done by two standard centrifugal compressors 26 and 28 in tandem, each of which increases the pressure of the air by a factor of 3.16 after cooling back to ambient (the square root of ten). An air filter and desiccator 25 is used to remove particulate matter and water vapor from the air prior to entering the first compressor 26. Using an adiabatic index for air of 1.4, it may be shown that each compression stage will increase the absolute temperature of the air by a factor of 1.39, or to about 141° C. starting from ambient temperatures. With a heat capacity at constant volume for air of 20.77 J/(mol K) the heat of compression over the two stages is thus 54 watt hours per cubic meter of ambient air compressed to ten atmospheres, or 83% of the total energy to be stored.

The air is cooled as it exits the each of the two compressors 26 and 28. This is done using the pump 39 to drive a stream of cool water through the countercurrent heat exchangers 27 and 29 in the exits of the compressors 26 and 28, respectively. In this way the heat of compression preheats the water, which in turn is directed through a pipe to the nozzle 22 where, during the first half of the charging process (see FIG. 3), it is boiled by the compressed methanol vapor, as previously described. Later in the charging process, i.e. once the theoretical coefficient of performance of the methanol heat pump has fallen below 3 or so, the compression ratio of the compressor 19 is lowed so that the methanol vapor is raised to at most 100° C. At the same time the rate of water flow through the air compressors 26 and 28 is increased so that it is not preheated as much, with the net result that now the water is not boiled but instead merely heated and recirculated (as indicated in FIG. 4). The compressed air itself is directed through the open valve 30 to the NaX beds 1, as indicated in FIG. 7. Any residual heat of compression remaining in it will subsequently be removed in the course of cooling the NaX beds 1 and wind up in the steam or water exiting the tank 20 as well. This steam or water thus contains most of the heat of compression and of adsorption of the air, as well as the sensible heat removed from the NaX beds 1 to cool them.

During the first half of he charging process (FIG. 3), the high-grade heat contained in the steam exiting the tank 20 is used to prime an adsorption heat pump that uses NaX-water as its adsorbent-adsorbate pair. This open adsorption system is modeled after one recently demonstrated by Andreas Hauer in the Federal Republic of Germany, where it was used to reduce the cost of heating buildings by desorbing water from the NaX at night and using the re-adsorption of water vapor to upgrade waste heat during the day when the demand for heating is greater (see section 2 of chapter 25 by A. Hauer, pp. 40-27 in "Thermal Energy Storage for Sustainable Energy Consumption," NATO Sci, Ser. II: Math., Phys. and Chem., vol. 234, H. O. Paksoy, ed., Springer, 2007). This open adsorption heat pump is simply a thermally insulated tank 40, constructed in an embodiment from a heat-resistant fiberglass composite as before, which is filled with NaX pellets 41 similar, but not necessarily identical in form, to those used to adsorb the air.

Thus an AE-CAES embodiment also utilizes the NaX zeolite for the second new use of adsorption in porous materials of the invention. It should nevertheless be emphasized that a great many other porous materials, such as silica gel, are available that can also be used to pump heat via the adsorption of water, or indeed any other suitable fluid. The water-NaX adsorbate-adsorbent pair used here is chosen because, like the air-NaX pair, the adsorbate is inexpensive and environmentally benign, while the adsorbent is well understood, not prone to degradation with repeated use (when a suitable binder is used for the pellets; see G. Starch, G. Reichenauer, F. Scheffler and A. Hauer, Adsorption 14, 275, 2008), and commercially available. A further advantage of the water-NaX system lies in the fact that the differential heat of adsorption of water vapor to NaX increases from a value close of that of the heat of vaporation of water, or 44 KJ/mole, to about twice that value as the amount of water adsorbed to the NaX falls from 30 to 0% by weight. This means that in addition to providing a means of upgrading heat to higher temperatures, the NaX bed 41 of the heat pump will also store a significant amount of heat in latent (as well as sensible) form, even after deducting the heat needed to evaporate water during discharge. Because the heat of adsorption of water vapor to NaX is so much larger than the heat of adsorption of air to NaX, the amount of NaX needed for this adsorption heat pump is only a fraction of that which is required to adsorb the air itself.

Once again during the first half of the charging process (FIG. 3), the steam from the tank 20 passes through vents 23 in its top to another compressor 31, which raises the steam's pressure by a factor of 2.8 and, since the adiabatic index of water is also about 1.3, its temperature to about 200° C. It then passes via the open valve 32 to a heat exchanger 36, where the steam is cooled, by a countercurrent stream of atmospheric air which is blown over the heat exchanger by the fan 37, heating the air to a temperature of about 150° C. in the process. The Carnot limit on the coefficient of performance for this heat pump is 7.5, which should be comparable to the average coefficient of performance of the methanol compressor 19 over the first half of the charging process. It should be noted that the energy needed by the compressors 19 and 31 also winds up as stored heat, and may subsequently be recovered thereby making up for losses elsewhere in the system; the energy needed to run the fan 37 is not significant by comparison.

The hot air from the heat exchanger 36 flows into the thermally insulated tank 40 and through the unpressurized bed of NaX zeolite pellets 41, which initially have about 30% of their weight in water adsorbed to them (see FIG. 10). The hot air raises the temperature of the NaX pellets 41, causing this water to desorb from them in the form of water vapor and cooling the air in the process. This water vapor is carried by the air through the NaX-pellet-packed container 40 and exits from its other end in the form of moist air at a temperature of about 40° C. The steam used to heat the air entering the NaX bed 41 exits from the heat exchanger 36 through the pressure-reducing valve 38, whereupon it also cools down well below the normal boiling point of water and largely condenses.

Because no heat transfer is ever complete, this water still holds a portion of the heat it contained entering the heat exchanger. The energy contained in this sensible heat is stored by returning the water to the surface of the reservoir 43 from which it originated.

Similarly, the warm moist air exiting from the NaX bed 41 passes over a condenser 47 through which water is passed via the action of the pump 44. This water flows from the cool bottom of the reservoir 43 through the condenser 47 and back through the open valve 50 to the warm surface of the reservoir 43. The heat of condensation is thereby likewise transferred to the surface water of the reservoir. The need to use the heat of condensation for efficiency's sake has been stressed by A. Hauer (loc. cit.), and the option to store it in a reservoir has also been claimed in a more recent patent (U.S. Pat. No. 6,820,441). The condensed water itself collects in the basin 49, and may be discarded or added to the reservoir 43 once an AE-CAES embodiment is fully charged.

In contrast, during the latter half of the charging period (FIG. 4), the fan 37 is turned off and the container 40 sealed so that moisture cannot prematurely re-adsorb to the NaX bed 41 it contains. Instead of steam at 200° C., hot water at well below its boiling point flows directly from the tank 20, where it has picked up heat from the hot compressed methanol vapor, through the now-open valve 35 which by-passes the now-passive compressor 31, and on to the surface of the reservoir 43 without further cooling. In this way the heat generated by the compression and adsorption of the air during the latter half of the charging period, as well as the remaining sensible heat in the NaX bed 1, also winds up in the reservoir 43. How this heat is subsequently recovered will be described below.

Once an AE-CAES embodiment has been fully charged, the majority of the mechanical energy put into it is stored largely in the form of adsorbed air in the NaX pellet bed 1 within the cylinders 2. As previously noted, about 83% of this energy is also stored as heat, primarily in the water reservoir 43. In addition, several times more energy has been taken out of the NaX bed 1 in the form of heat, the majority of which was sensible heat with a smaller but significant contribution from the heat generated by adsorption of the air. Most of this heat will likewise be stored as sensible heat in the water reservoir 43, although a significant amount will also be stored as both latent and sensible heat in the NaX bed 41 of the adsorption heat pump.

As long as the valves 30 and 56 are kept closed to trap the compressed and adsorbed air, essentially none of the energy stored in this form will be lost prior to discharge. Similarly, as long as the container 40 is kept sealed from moisture, none of the energy stored as latent heat in the NaX bed 41 will leak from it prior to discharge. As shown above, a considerably larger quantity of heat will be stored as sensible heat in the water reservoir 43, but the rate at which this heat leaks from the reservoir will not be large because the temperature difference between the water and the reservoir's environment will not be large (well under 100° C. even in cold weather). Another, less direct, form of loss would be from heat leaking into the chamber with walls 4, raising the temperature of the NaX beds 1 therein and forcing release of some of the compressed air to keep the pressure from rising beyond that which the cylinders 2 are able to withstand. Once again, however, the AE-CAES embodiment strives to keep these temperature differences low by using minimum and maximum temperatures symmetrically placed about 70° C. below and above normal ambient temperatures. For such modest temperature gradients, standard low-cost insulation such as polyurethane foam should keep all of the loses due to sensible heat leakage down to an acceptable level over the anticipated storage period of a day or less.

When the time comes to recover the mechanical energy stored in an AE-CAES embodiment, warm water from the surface of the reservoir is directed through the heat exchanger 16 by closing the valve 50 and opening the valve 51. At the same time the fan 37 is used to blow ambient air through the NaX bed 41 of the adsorption heat pump, where it picks up sensible heat from the bed but not much of the latent heat because it does not contain much moisture to re-adsorb. Some of this heat will be transferred to the water flowing through the heat exchanger 47 at the exit, whence it continues to the heat exchanger 16, but most of the heat will be carried along with the air into the exit chamber 48 at a still elevated temperature. This warm air is directed via the duct 52 to an air turbine, which includes components 53, 54 and 55, by rearranging the baffling in the exit chamber 48, as indicated schematically in FIGS. 7 and 8. It will be used there to keep the expanding compressed air from cooling, as will be described presently.

Meanwhile, the warm water flowing through the heat exchanger 16 boils the methanol in the storage tank 15, which is initially under a pressure of a fraction of an atmosphere. The resulting methanol vapor is then used to heat the cylinders 2 containing the NaX pellet beds 1 to which air is adsorbed, as previously described. This converts the adsorbed air to compressed air at a rate that is controlled by controlling the rate at which methanol vapor enters the chamber with walls 4. This compressed air is also directed as it is generated by desorption through the now-open valve 56 to the air turbine with components 53, 54 and 55, as shown in FIG. 8. The mass and energy fluxes during this first half of the discharging process are illustrated in FIG. 5.

Once about half the stored energy has been recovered and the temperature of the pressurized NaX bed 1 is approaching ambient temperatures, the valve 45 is opened to let warm water from the surface of the reservoir 43 pass through a vaporizer 46, which dispenses it as a mist over the heat exchanger 36. At the same time warm water from the reservoir 43 is driven by the pump 39 through the heat exchanger 36 via the open valve 34, and prevented from getting to the air compressors 26 and 28 by closing valves 32, 33 and 35, so as to keep the evaporating water from cooling the air around it. In this way the air from the fan 37 is saturated with water vapor prior to entering the unpressurized NaX bed 41, and heated by the process of adsorption of the water vapor as it passes through the unpressurized NaX bed. The mass and energy fluxes during this second half of the discharging process are illustrated in FIG. 6. Of course the use of a simple vaporizer such as 46 is not essential to the invention, and could easily be replaced by an impeller or ultrasonic humidifier if so desired.

Hauer (loc. cit.) has shown that the air will exit the far end of the adsorption heat pump container 40 at a temperature in excess of 100° C. As it does so, a portion of the heat it contains will be transferred via the heat exchanger 47 to the counter-current stream of warm water from the surface of the reservoir 43, heating it gradually towards 100° C. as the discharge process progresses. This will raise the temperature and pressure of the methanol vapor generated in the tank 15 to ever higher levels, thereby heating the NaX beds 1 in the cylinders 2 to 100° C. at the end of the discharge process. At the same time the water passing through the heat exchanger 36 has been cooled and is returned to the bottom of the reservoir 43 to be used the next time the device is charged.

The efficiency of the AE-CAES embodiment is also improved by passing the air, during discharge through the unpressurized NaX pellet bed 41 in approximately the reverse of the direction in which hot air was passed through it in order to desorb moisture from the unpressurized NaX bed during charging. This increases the efficiency because otherwise some of the sensible heat picked up by the air entering the bed during the first half of the discharge process, or generated by the adsorption of moisture from the air during the second half, will be lost to the cooler and/or less dry NaX bed before it reaches the far end. This approximate reversal of the flow is accomplished by a system of internal baffles 42, depicted by heavy solid lines in the drawings, which are arranged so that during charging the air enters the near end through the center of the bed but exits the far end around the periphery, and then rearranged during discharging so that the air enters the periphery on the near end but exits through the center on the far end, as indicated schematically in FIGS. 7 and 8 (see also FIG. 10). Of course other embodiments are possible in which the far end includes a second fan, enabling the air to take exactly the opposite path back through the NaX bed 41 while the roles of the heat exchangers 36 and 47 are swapped while discharging the device.

Finally, we describe how the warm air entering the exit chamber 48 and passing via the duct 52 is used to heat the expanding compressed air from the NaX bed 1 and thereby recover the heat of compression throughout both halves of the discharging process. This air turbine, which includes the components labeled 53, 54 and 55 in FIGS. 7 and 8, is designed so that the stream of compressed air entering it expands and accelerates through a venturi with twisted vanes running in parallel along its length (see FIG. 11). This creates a vortex which generates a vacuum behind it, which in turn draws the warm air from the duct 52 through a larger-in-diameter annulus of static blades 54 slightly up-wind of the blades 53. This second vortex of warm air merges with the vortex of cold expanding air from the blades 53 and is rapidly and thoroughly mixed with it by this process. The now rapidly moving air vortex hits the blades of the air turbine rotor 55 and thereby converts the energy stored in the compressed air and a portion of the energy stored as heat into mechanical form for external use. Of course many other devices are available, such as reciprocating air motors, by which heat and compressed air may be converted into mechanical energy in various alternative embodiments, although these will generally not be as efficient as the mixer-ejector air turbine just described.

Assuming that the AE-CAES embodiment releases one megawatt-hour of energy at a constant rate over a six hour period and that the compressed air is heated back to ambient temperatures in the process, the compressed air must be released at flow rate of about 700 $M^3$ per hour, measured at ambient temperature and pressure. The actual temperature of the compressed air will start out at −40° C. and gradually rise to near 100° C. over the six hour period, and air at −40° C. is 1.6 times more dense than air at 100° C. at any given pressure. It follows that the air at ten atmospheres must be released at a rate of 54 $M^3$ per hour at the beginning of discharge period and 86 $M^3$ per hour at the end. Under adiabatic conditions, this air would cool as it expands to −152° C. at the beginning and −80° C. at the end of the discharge period, which in turn would reduce the flow due to the release of compressed air to 283 and 454 $M^3$ per hour respectively. To return air at those temperatures to ambient temperatures, it must be mixed with about 8.87 and 5.25 times the same mass of air at a temperature of 45° C., the approximate temperature of the air entering the air turbine through the duct 52. The required flow rate of 45° C. air through the duct thus varies from 6628 to 3920 $M^3$ per hour over the six hour discharge period.

Using a 7000 kilogram NaX pellet bed, A. Hauer (loc. cit.) was able to heat an air flow of 6000 $M^3$ per hour to between 120 and 100° C., also over a six hour period, which corresponds to about 120 kilowatts of heat. Because only 83% of the energy is stored as heat, it follows that about 0.83×1000/6=138 kilowatts of heat will be needed by the turbine during the assumed 6 hour discharge period for one megawatt hour. Early in the discharge process it will not be necessary to heat the methanol by very much, so the rate of non-humidified air flow through the NaX pellet bed 41 can kept relatively high, and water can be pumped through the heat exchanger 47 at a high speed. The resulting air will enter the duct 52 at a temperature somewhat below the 45° C. assumed above, but its flow rate into the turbine will also be, greater than the 6628 $M^3$ per hour found above at 45° C. As the discharge progresses, the pump 44 is slowed so that by the end of the discharge period the temperature of the water exiting the heat exchanger 47 approaches that of the air passing over it, or 100° C. At the same time the rate of humidified air flow through the NaX pellet bed 41 is gradually slowed, so that near the end of the discharging process the temperature of the air entering the turbine through the duct 52 will be somewhat larger than 45° C. while its flow rate will also be less than the 3920 $M^3$ per hour estimated above at 45° C.

The components of the AE-CAES embodiment presented above include the water-NaX adsorption heat pump, the NaX zeolite bed that stores compressed air in adsorbed form, and advanced air turbines based on mixer-ejector principles. It also includes the control systems needed to make all these components work in synchrony, as described above. In particular, the pressure in the chamber with walls 4 and the rate at which methanol enters it during charging and discharging must be regulated so that compressed air is converted to and from adsorbed air at the same rate that it is produced by the compressors 26 and 28 or fed to the turbine including the components labeled 53, 54 and 55, respectively, thereby keeping the pressure of the gaseous air in the cylinders 2 approximately constant throughout. This task, although not trivial, is nevertheless a perfectly standard systems integration problem in chemical process engineering that can be accomplished by one skilled in that art.

Numerous substitutes may be employed for the mechanical and fluid components of the AE-CAES embodiment as well as for the materials it employs, all of which were chosen only the illustrate the advantages to be obtained through the use of adsorbents to facilitate the storage of compressed air and heat, along with the complementary temperature-swing cycle. Because the energy needed to run the pumps and compressors must be subtracted from the energy released in calculating the overall efficiency of an AE-CAES device, it is entirely possible that modest improvements to an embodiment could be attained by such substitutions, although they must still be subject to the Carnot limits given above. It should be noted, in particular, that we have refrained from saying where the motive force that drives the compressors 19, 26, 28 and 31 comes from, or what the mechanical force generated by the air turbine including components 53, 54 and 55 is used for. Normally compressors are driven by electric motors, but at a coal or nuclear power plant it would be more economical to drive them directly, for example via a hydraulic system, from the steam turbines of the power plant than it would to convert the mechanical energy from the turbines into electricity and then back to mechanical energy in the compressors. The same, of course, is true of an AE-CAES device installed at a wind turbine farm. Similarly, it could under some circumstances be more economical to use the compressed air released while discharging an AE-CAES device to power pneumatic tools or machinery, rather than to generate electricity.

The AE-CAES device, and/or a temperature-swing CAES device, could also employ a variety of other established chemical processes without materially deviating from the intent of the inventors. For example, the water-NaX heat pump 40 and 41 of an embodiment could be based on other adsorbate-adsorbent pairs, the absorption of a gas in a liquid medium, or even be replaced by a wide variety of solid-liquid phase-change materials, which can also store heat in latent form. It is further possible to supplement or replace the heat storage subsystem entirely by waste heat recovery or thermal energy harvesting in a variety of ways. If, for example, an AE-CAES device were located at a power plant that produces heat as a by-product, such as a coal or nuclear power plant, then this heat could be used to reheat the expanding air and/or the adsorbent for air. Alternatively, a flat-plate solar thermal collector could also readily generate the modest temperatures needed when discharging an AE-CAES device, installed for example at a wind turbine farm. The main point is that the heat utilized by any component of an AE-CAES device during discharge need not have been produced by the inverse process while charging it.

Given a suitable inexpensive source of heat, it would also be possible to use it to regenerate an adsorbent refrigeration system during the storage or discharge period, which could be utilized instead of the vapor-compression refrigeration system of an embodiment to cool the NaX bed while it adsorbed air during the charging period. In cases where such environmental heat sources are not always available at the time they are needed, the heat could be stored when available in either sensible or latent form along with the heat generated while charging the device, and used to make up for any energy loses due to incomplete heat transfer. It should also be possible to reduce the size of the temperature swing needed for a high duty cycle, and hence the amount of heat that must be taken from and returned to the adsorbent for air, by using some combination of a temperature and pressure swing instead of a pure temperature swing as in the above AE-CAES embodiment. These variations could significantly improve the economics of building and/or operating an AE-CAES device in many of its diverse potential applications.

In a second embodiment, an adsorption heat pump is used to refrigerate the porous material that adsorbs air while charging the system with compressed air, as an alternative to heating that porous material during discharge. This has the advantage that it can reduce the amount of energy that must be expended running vapor-compression heat pumps, because the temperature difference over which the heat is pumped may be considerably reduced. This temperature difference depends on a number of factors such as the adsorbent-adsorbate pair that is utilized by the adsorption heat pump, the availability and temperature of inexpensive waste or solar heat, the temperature at which sensible heat is stored in the water reservoir or other thermal energy storage subsystem, the temperature of the external environment, and the other operating parameters of the energy storage device. The amount of extra mechanical energy that must be expended to transfer a given quantity of heat via a vapor-compression heat pump, in turn, fails off rapidly as this temperature difference decreases. Since this extra energy cannot be recovered like the mechanical energy that is stored in the form of compressed and adsorbed air, it must be deducted from the recovered energy in order to calculate the round-trip efficiency of the energy storage system. It follows that the second embodiment may under some circumstances provide a more efficient energy storage device.

Before describing the second embodiment in detail, however, a more refined estimate of the density with which air and energy can be stored in a packed bed of NaX pellets will be given. This estimate improves upon those given earlier in the following respects. First, instead of assuming that the adsorption of nitrogen and oxygen from air are independent processes, the Sipps multi-component isotherm formula will be used to extrapolate the number of air molecules adsorbed as a function of pressure from the pure gas $N_2$, $O_2$ and Ar isotherm formula [G. W. Miller, AIChE Symp. Ser. 83, 28, 1987], Second, instead of estimating a "duty cycle" over a temperature swing of −40 to +100° C. by extrapolating from the estimated quantities of air adsorbed at −40, 24 and 50° C., explicit pure gas isotherms at 100° C. were extrapolated from those at these three lower temperatures by a least squares fit of the logarithms of the coefficients in the Langmuire (or Sipps, for $N_2$) isotherms to the inverse absolute temperatures, and setting the exponent in the Sipps isotherm for $N_2$ to its high-temperature asymptote of unity. Such a linear dependence is implied by the van't Hoff equation of thermodynamics, and the resulting pure gas isotherms can then be used to estimate the mixed gas isotherm at 100° C. via the extended Sipps formula, just as at the three lower temperatures. Even though the van't Hoff equation will be only approximate at the temperatures and pressures of interest here and the fits, although reasonably precise, were based on only three points each, such an objective procedure was deemed more rigorous than the previous ad hoc estimates. Third, the stored energy densities associated with the quantities of air adsorbed over the range of operating pressures considered were estimated using an isothermal expansion from the assumed working pressure to one atmosphere, instead of to zero pressure as in the simpler formula used previously. In addition, the work done by the air as it is desorbed at the working pressure is included. It turns out that these last two refinements in our model of the expansion process largely cancel one another, so the resulting energy density estimates are similar to those obtained by our previous less rigorous procedures.

Figure 12:
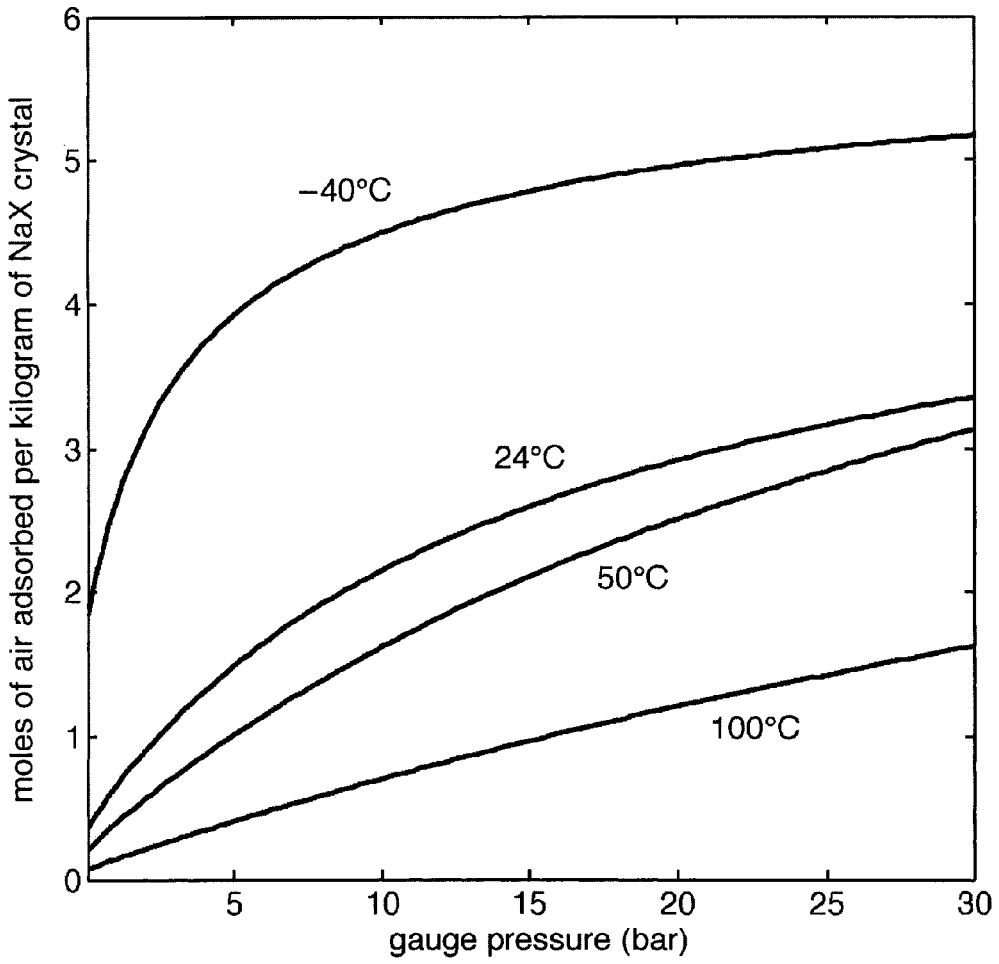
FIG. 12 plots the adsorption isotherms or air on the zeolite NaX at four different temperatures, which were extrapolated from the published data.

FIG. 12 plots the graphs of the mixed gas air isotherms for NaX at the temperatures of −40, 24, 50 and 100° C., derived as described above. Assuming as before that the NaX pellets are 20% inert binder by volume, that the volume of the intragranular macropores is negligible, and that the pellets are packed into an adsorbent bed with a volumetric density of 80%, these isotherms imply the quantities of air shown in Table 1 below for various temperatures and pressures. The dimensionless numbers in the table are the volumes which the air contained in a unit volume of adsorbent bed would occupy in the form of a free gas at the standard temperature and pressure (STP) of 25° C. and one atmosphere, assuming an STP molar volume of 24.8 liters.

TABLE 1

| | gauge pressure (bar): | | | | | | |
|---|---|---|---|---|---|---|---|
| | 0 | 5 | 10 | 15 | 20 | 25 | 30 |
| volume of air at STP stored per unit volume NaX bed at −40° C.: | 45.0 | 96.7 | 111.8 | 119.9 | 125.3 | 129.4 | 132.7 |
| volume of air at STP stored per unit volume NaX bed at 24° C.: | 9.0 | 37.3 | 54.2 | 65.9 | 74.7 | 81.5 | 87.1 |

TABLE 1-continued

| | gauge pressure (bar): | | | | | | |
|---|---|---|---|---|---|---|---|
| | 0 | 5 | 10 | 15 | 20 | 25 | 30 |
| volume of air at STP stored per unit volume NaX bed at 50° C.: | 5.2 | 25.6 | 41.2 | 53.8 | 64.4 | 73.5 | 81.3 |
| volume of air at STP stored per unit volume NaX bed at 100° C.: | 1.9 | 10.7 | 18.6 | 25.8 | 32.4 | 38.4 | 44.0 |

Note that at 10 bar we obtain a duty cycle over a −40 to 100° C. temperature swing of (111.8-18.6)/111.8=83%, in agreement with our earlier estimate. The results in Table 1 also lead directly to those in Table 2 below, where we compare the quantities of air released from a unit volume of NaX bed over various temperature and pressure swings with those released from a unit volume tank devoid of NaX over a simple pressure swing starting from the working pressure given in the column heading and decreasing to atmospheric pressure, all at 25° C.

TABLE 2

| | gauge pressure (bar): | | | | | | |
|---|---|---|---|---|---|---|---|
| | 0 | 5 | 10 | 15 | 20 | 25 | 30 |
| P-swing at 24° C. in an NaX bed over P-swing w/o 13X at 25° C.: | N/A | 5.7 | 4.5 | 3.8 | 3.3 | 2.9 | 2.6 |
| 24 to 100° C. T-swing in 13X bed over P-swing w/o 13X at 25° C.: | N/A | 5.3 | 3.6 | 2.7 | 2.1 | 1.7 | 1.4 |
| (T, P)-swing of (24, X) to (100, 0) over P-swing w/o at 25° C.: | N/A | 7.1 | 5.2 | 4.3 | 3.6 | 3.2 | 2.8 |
| −40 to 100° C. T-swing at P = X in 13X bed over P-swing w/o at 25° C.: | N/A | 17.2 | 9.3 | 6.3 | 4.6 | 3.6 | 3.0 |
| (T, P)-swing of (−40, X) to (100, 0) over P-swing w/o at 25° C.: | N/A | 19.0 | 11.0 | 7.9 | 6.2 | 5.1 | 4.4 |

It may be seen that the improvement in the duty cycle when NaX is used in conjunction with a temperature swing between −40 and 100° C., relative to a simple pressure swing at 25° C. without NaX, is 17.2 at 5 bar and falls off by about a factor of two for every doubling of the pressure. The amount of NaX needed to release a given quantity of air, however, will fall off more slowly beyond about 10 bar because it is largely saturated with air at that pressure and −40° C. (cf. FIG. 12). Similarly, since NaX holds less than 20% of that air at 10 bar and 100° C., the improvements to be gained by lowering the pressure below 10 bar are also fairly limited. These observations support our earlier conclusion that an operating pressure of about 10 bar will be optimal for the system when a −40 to 100° C. temperature swing is employed. The density with which air is stored relative to a simple pressure swing may be increased from 9.3 to 11.0 when this same temperature swing is combined with a pressure swing (see last row of Table 2), but such a mere 18% improvement is probably not worth the additional expense of the hardware needed maintain a constant output power over such a large pressure variation.

Figure 13:
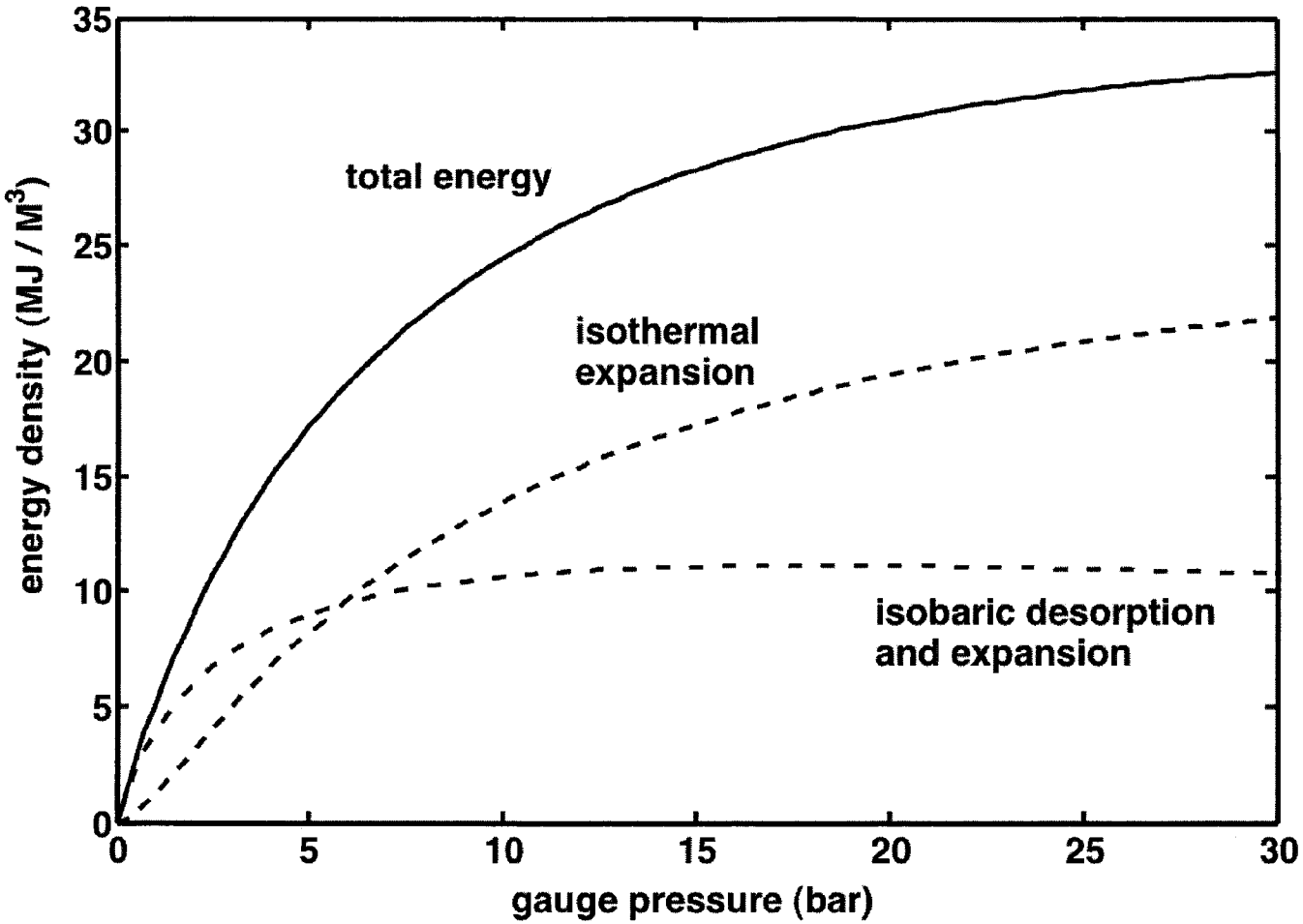
FIG. 13 plots the density with which a bed of NaX pellets is expected to store energy, based on the isotherms of FIG. 12 over a −40- to - 100° C. temperature swing as a function of the fixed working pressure.

Accordingly, we assume as before that the air is desorbed from NaX at constant pressure by means of a −40 to 100° C. temperature swing, and subsequently expanded in an isothermal process at 25° C. This allows the mechanical work done while discharging the system to be divided into two parts. The first is the work done by the air as it is desorbed and allowed to expand as necessary to keep the pressure constant as the NaX bed is warmed from −40 to 100° C., and the second is the work done by the air during isothermal expansion back to atmospheric pressure at 25° C. (which is approximately the average temperature of the NaX bed over the cycle). FIG. 13 plots these two contributions to the total PV work done as a function of the operating pressure, keeping the temperature swing at −40 to 100° C. throughout. The work done during isobaric desorption and expansion of the air is essentially constant beyond 10 bar, at which pressure it is also about 75% of the work done during the subsequent isothermal expansion. These observations further support our earlier conclusion that this pressure roughly maximizes the benefit derived from using a bed of NaX to adsorb the air.

Due to the above-mentioned cancellations in our more refined but still idealized expansion model, the estimated density with which energy is stored in the NaX bed at a (gauge) pressure of 10 bar comes out to 6.9 kWhr/$M^3$ almost exactly as in our earlier estimate. The heat of adsorption remains about twice the mechanical energy stored, and the sensible heat that must be taken from and returned to the NaX bed over the storage cycle remains several times larger yet. In principle, all this heat can be stored while charging the system with compressed air and recovered again while discharging it, which would allow an AE-CAES system to be operated as a "pure" energy storage device. For ease of presentation both the original as well as the second embodiment presented below were designed to operate, to the maximum extent possible, in this fashion. In practice however the expense of such a highly efficient thermal energy storage subsystem would be substantial, and the additional energy used by the vapor-compression heat pumps needed to move this heat around preclude a highly efficient energy storage system in any case. A less expensive AE-CAES device could be obtained by using a less efficient thermal energy storage subsystem while making up for the resulting thermal energy losses with an external heat source of some kind. In the simplest case, this external heat could just be added to the hot water reservoir, which both the original as well as second embodiment already use for thermal energy storage.

One caveat that must be noted is that this additional thermal energy must be deducted in calculating the physical round-trip efficiency of an adsorption-enhanced CAES system, regarded as a pure energy storage device. Fortunately, this additional heat does not need to be at a temperature much above 100° C. in order to heat the NaX bed to that temperature while discharging the stored mechanical energy. Moreover, the methanol-and-activated-carbon-based adsorption refrigerator used in the second embodiment to cool the bed back to −40° C. (see below) can also be regenerated using heat at similar modest temperatures. As a result, an AE-CAES system can be economically efficient even if it is not "efficient" in the strict physical sense of the word. By this we mean that the cost of the additional thermal energy needed can be quite trivial in comparison to the value of the stored mechanical energy itself. Indeed heat at such modest temperatures is often regarded as "waste" and discharged directly into the environment, and even when such a waste stream is not available heat at these same modest temperatures can often be obtained from inexpensive solar thermal collectors.

Figure 14:
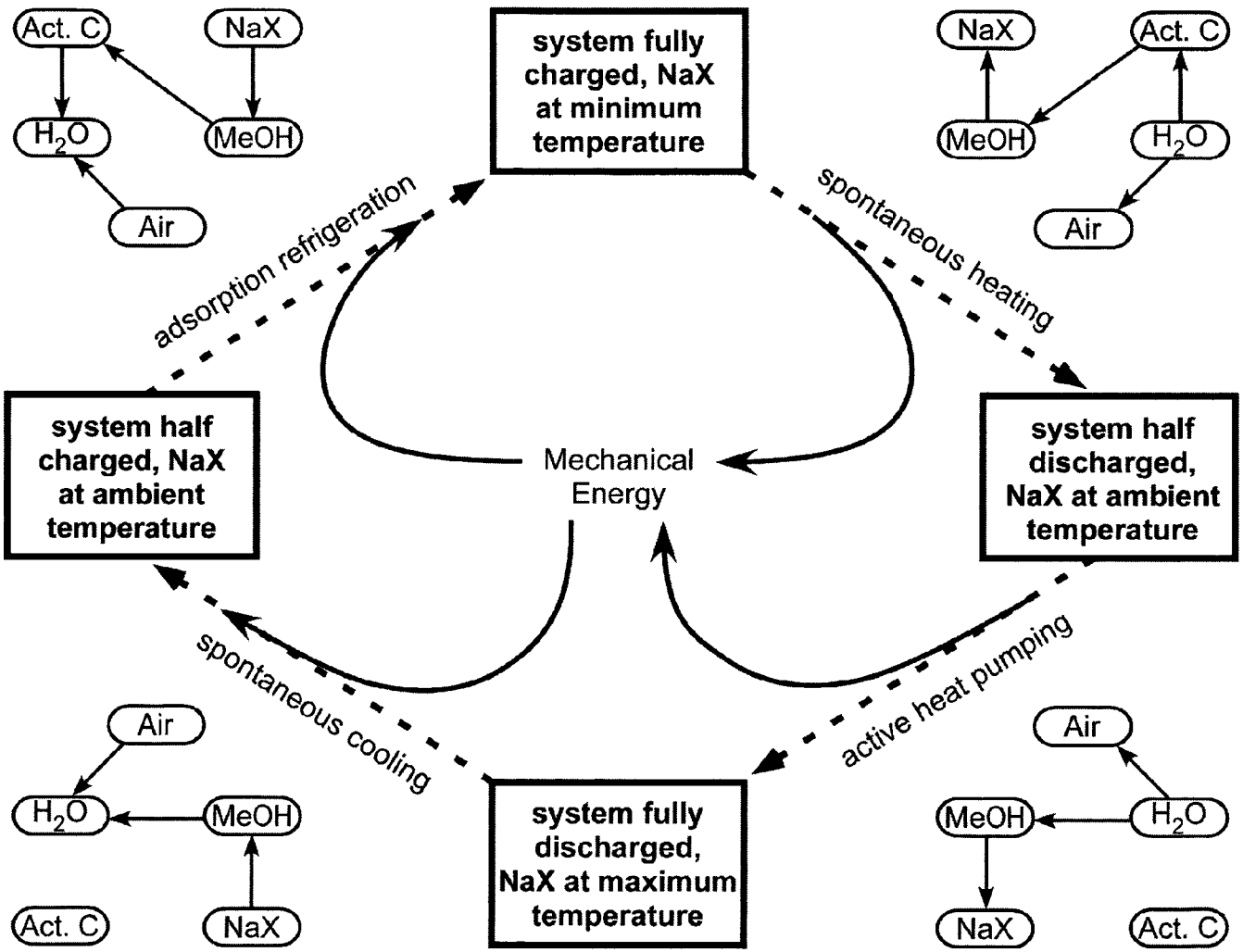
FIG. 14 depicts the four legs of the storage cycle of a second adsorption-enhanced compressed air energy storage embodiment, along with the flows of heat among the principal thermal reservoirs of the embodiment.

Turning now to the second embodiment, we begin with the overview of the energy storage cycle shown in FIG. 14. The state of the system at the beginning of each of the four legs of the cycle is described in the boxes at the bottom, left, top and right of the figure, while the diagrams in the four corners indicate the heat flows between the various components of the system during each leg. In greater detail, these legs of the cycle are:

The first half of the charging process, which is labeled "spontaneous cooling" because the temperature of the NaX bed will exceed that of the cold (or near-ambient temperature) water reservoir, so that heat flows spontaneously from the NaX to the water. In this embodiment, the heat is carried from the NaX to the water by actively circulating methanol between these two thermal reservoirs. At the same time air is compressed by the input of mechanical energy, the heat of compression transferred to the water reservoir, and the cooled and compressed air adsorbed by the NaX bed.

The second half of the charging process, labeled as "adsorption refrigeration" because during this leg of the cycle methanol vapor is adsorbed in an activated carbon bed as it evaporates and carries heat from the NaX bed. This heat, together with the heat of adsorption of the methanol vapor to it, is transferred from the activated carbon to the water reservoir as before. Meanwhile air continues to be compressed by mechanical energy, the heat of compression transferred to the water reservoir, and the air adsorbed by the NaX until it has reached its minimum temperature over the cycle.

The first half of the discharging process, labeled as "spontaneous heating" because now the temperature of the NaX bed is below ambient so that heat would flow spontaneously into it from the cold water reservoir. In order to attain the higher temperatures needed to desorb the methanol from the activated carbon and so regenerate it for use in the next cycle, however, the heat is first transferred from the hot water reservoir to the activated carbon. From there the heat is carried by the methanol vapor to a heat exchanger in contact with the NaX bed, where it condenses, and the resulting liquid is stored for use in the next cycle. This in turn warms the NaX bed from its minimum temperature back to approximately ambient temperatures, causing a portion of the air it contains to desorb. The desorbed air is allowed to expand back to atmospheric pressure while also taking up heat from the hot water reservoir and producing the output mechanical energy.

The second half of the discharging process, labeled "active heating" because during this leg of the cycle the NaX bed is actively heated back to its maximum temperature over the cycle, and this temperature will be at least that of the unpressurized hot water reservoir. In this embodiment, the heat is moved from the hot water reservoir to the NaX again using methanol as a heat transfer fluid. As a result the NaX bed desorbs its remaining air, which expands taking up additional heat from the water reservoir and producing additional output mechanical energy in the process.

As in the first embodiment, heat is actively transferred between its thermal reservoirs using vapor-compression heat pumps. Two such heat pumps are utilized by the second embodiment, one of which uses methanol as its working fluid and the other of which uses a conventional halocarbon refrigerant. For completeness, we further note that when external sources of heat at 100° C. or more are available, they can be used instead of, active heat pumping thereby saving the energy overhead associated with vapor-compression heat pumps. Such external heat sources can also be used to regenerate the activated carbon bed, in which case the cold in the NaX bed could be used for refrigeration or air conditioning in a building. Either of these uses of external heat could also make up for thermal loses from the hot water reservoir or during the various heat transfers in the cycle. They could even free up enough of the heat stored in the hot water reservoir to allow it to be used for space heating or hot water in a building. Once again, for simplicity's sake we will not consider all these alternatives to running an AE-CAES system as a "pure" energy storage device here, although in many situations this may be the most economical way to use it.

FIGS. 15 through 18 show more detailed but still schematic views of the second embodiment at the beginning of each one of the four legs of the storage cycle, in the same order as given above. The parallel lines depict the piping of the system, while the sizes of the dashes between them indicate the kind of fluid flowing through the pipe. Air is indicated by an intermediate length normal dash, while a long bold dash indicates water, an intermediate bold dash methanol, and a short bold dash a conventional halocarbon refrigerant. In these four figures, open valves are depicted by hour-glass shapes parallel but behind the "pipes", and closed valves by hour-glass shapes which cover the pipes. The pressure-reducing expansion valves of the vapor-compression heat pumps are asymmetrical hour-glass shapes, which should be understood to include a by-pass that allows the flow through them to be reversed without any effect upon pressure. The four-way valves which determine the direction of heat flow in the two heat pumps are depicted by circles with a diagonal line through them, with the fluid flow passing through the pairs of ports not cut off by the line. The compressors of the two heat pumps are depicted as isosceles trapezoids which receive their low-pressure input stream in the large end and eject their high-pressure output stream from the narrow end, as is traditional in engineering diagrams. Positive-displacement liquid pumps are shown as circles, with a filled triangle in them indicating the direction of flow when they are operating, or which simply sit on top of the pipe without a triangle when not operating. Heat exchanger subsystems are indicated by zigzags in the piping, as in the two that are contained in the air compressor and expander on the left-hand sides of the four figures. These are likewise drawn as isosceles trapezoids, which however take their air in and out through pipes in their sides, as indicated.

The thermal energy storage subsystem of the second uses separate reservoirs for the cold and hot water, rather than keeping the cold water at the bottom and the hot water at the top of a single reservoir. This should improve the efficiency of the subsystem, but is not critical to its operation. As mentioned above, methanol is the working fluid used to move heat from the air-adsorbing NaX bed to the water as it is pumped from the cold reservoir to the hot while charging, and back from the water to the NaX bed as it is pumped from the hot reservoir to the cold while discharging the AE-CAES system. This is done using the methanol vapor-compression heat pump H.P. #1 during the first half of the charging and second half of the discharging processes. During the second half of the charging and first half of the discharging processes, however, heat is moved to and from the NaX bed by an adsorption heat pump based on methanol and activated carbon, which constitute the adsorbate and adsorbent, respectively. The heat in the activated carbon bed, in turn, is transferred to and from the water reservoir by a second vapor-compression heat pump H.P. #2, which is based on a conventional halocarhon refrigerant such as dichloromethane. This second heat pump is also used to cool and to heat the air during compression and expansion, respectively, as well as to heat and to cool the methanol reservoir when H.P. #1 is in use and the adsorption heat pump is not.

Figure 15:
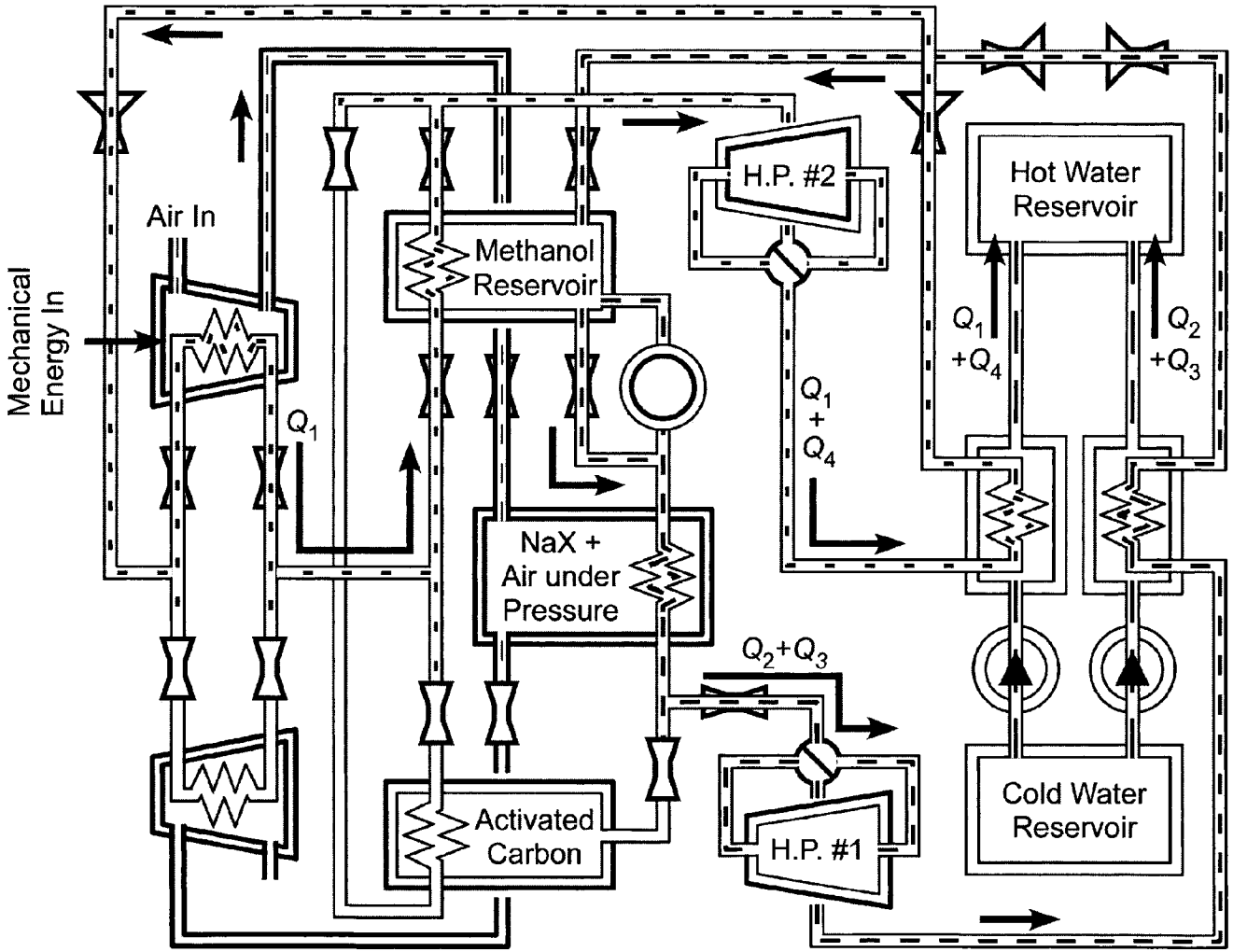
FIG. 15 is a simplified process flow diagram illustrating the mass and energy flows in the second adsorption-enhanced compressed air energy storage embodiment during the first leg of the storage cycle (or first half of the charging process)
Figure 16:
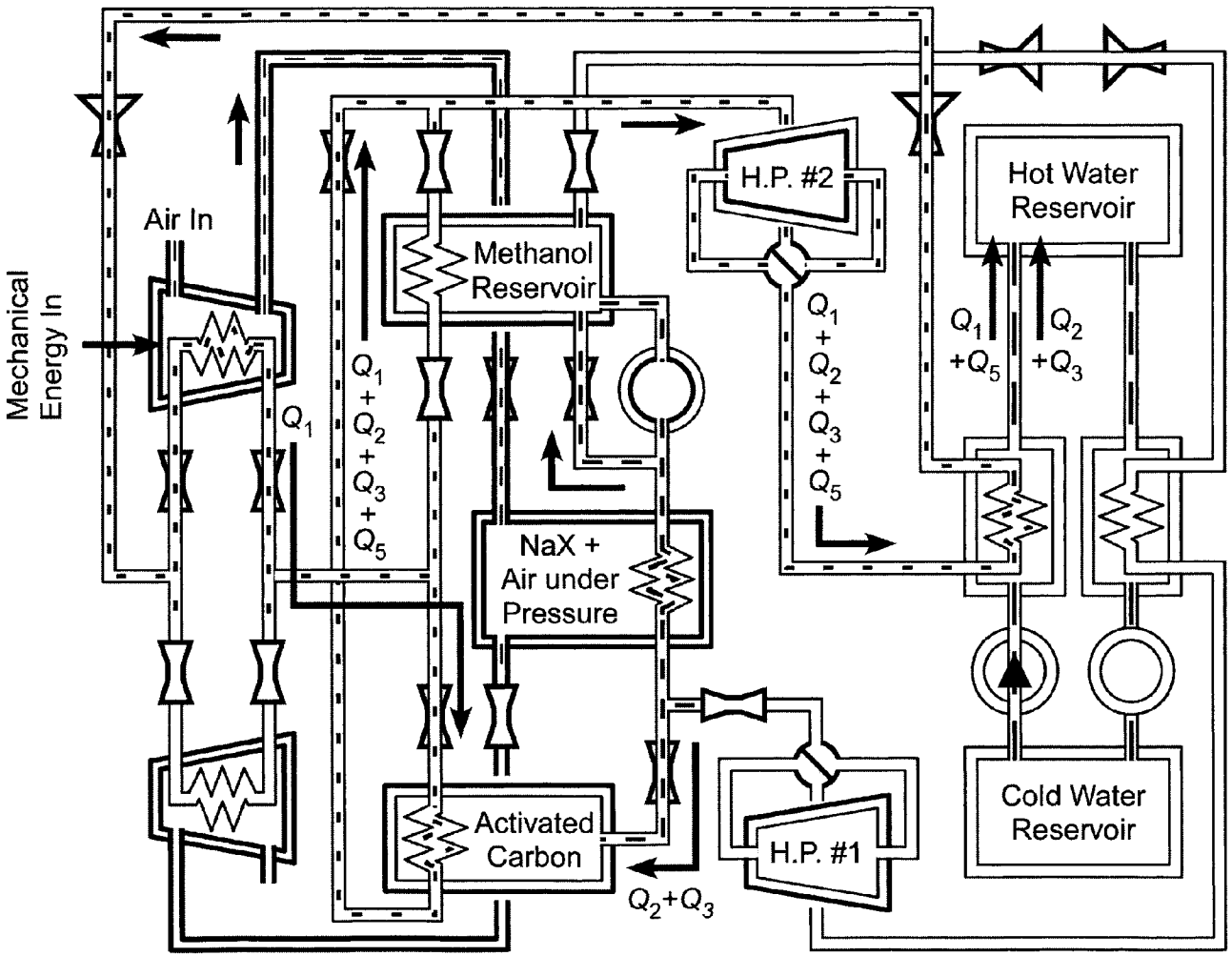
FIG. 16 is a simplified process flow diagram illustrating the mass and energy flows in the second adsorption-enhanced compressed air energy storage embodiment during the second leg of the storage cycle (or second half of the charging process)
Figure 17:
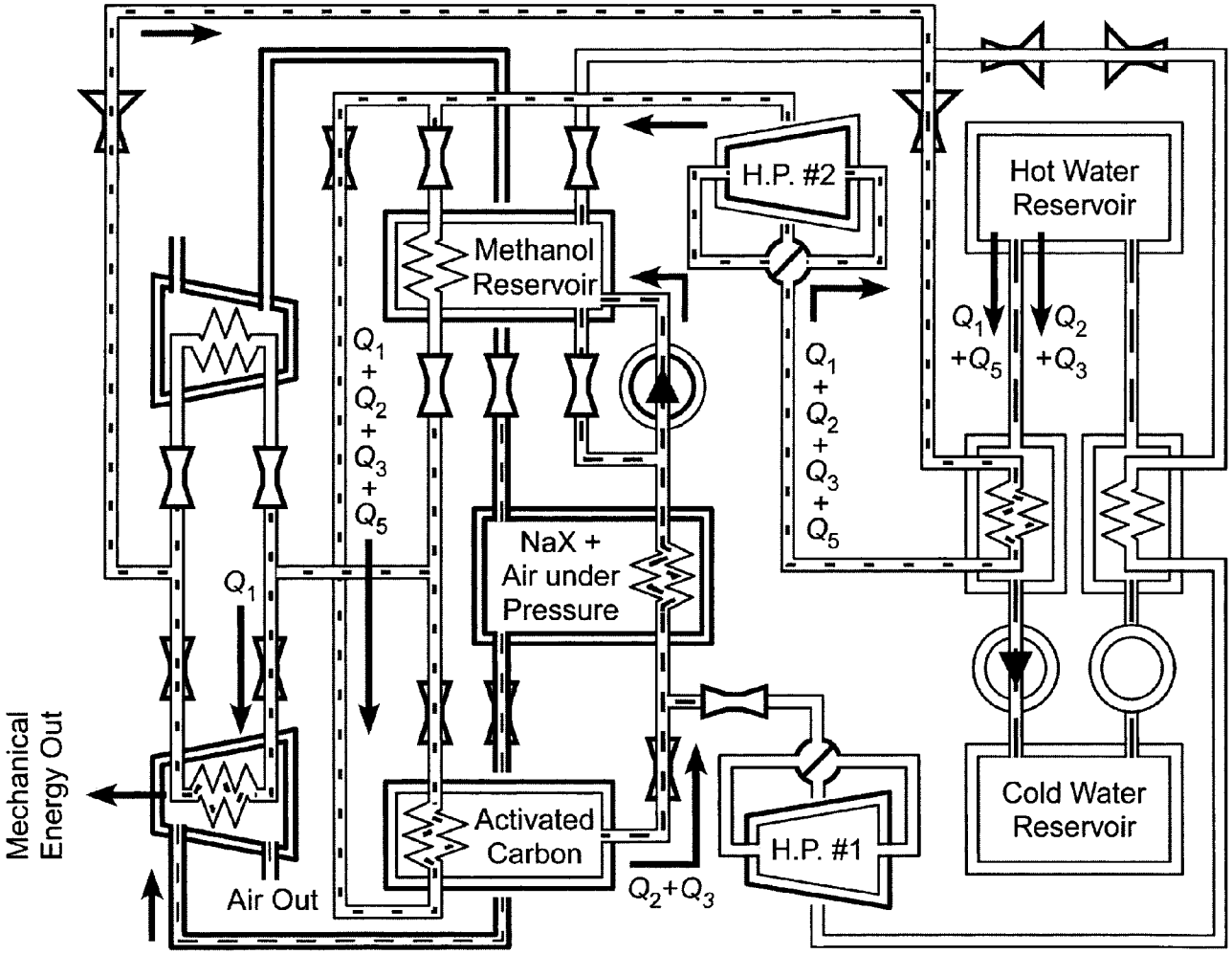
FIG. 17 is a simplified process flow diagram illustrating the mass and energy flows in the second adsorption-enhanced compressed air energy storage embodiment during the third leg of the storage cycle (or first half of the discharging process)
Figure 18:
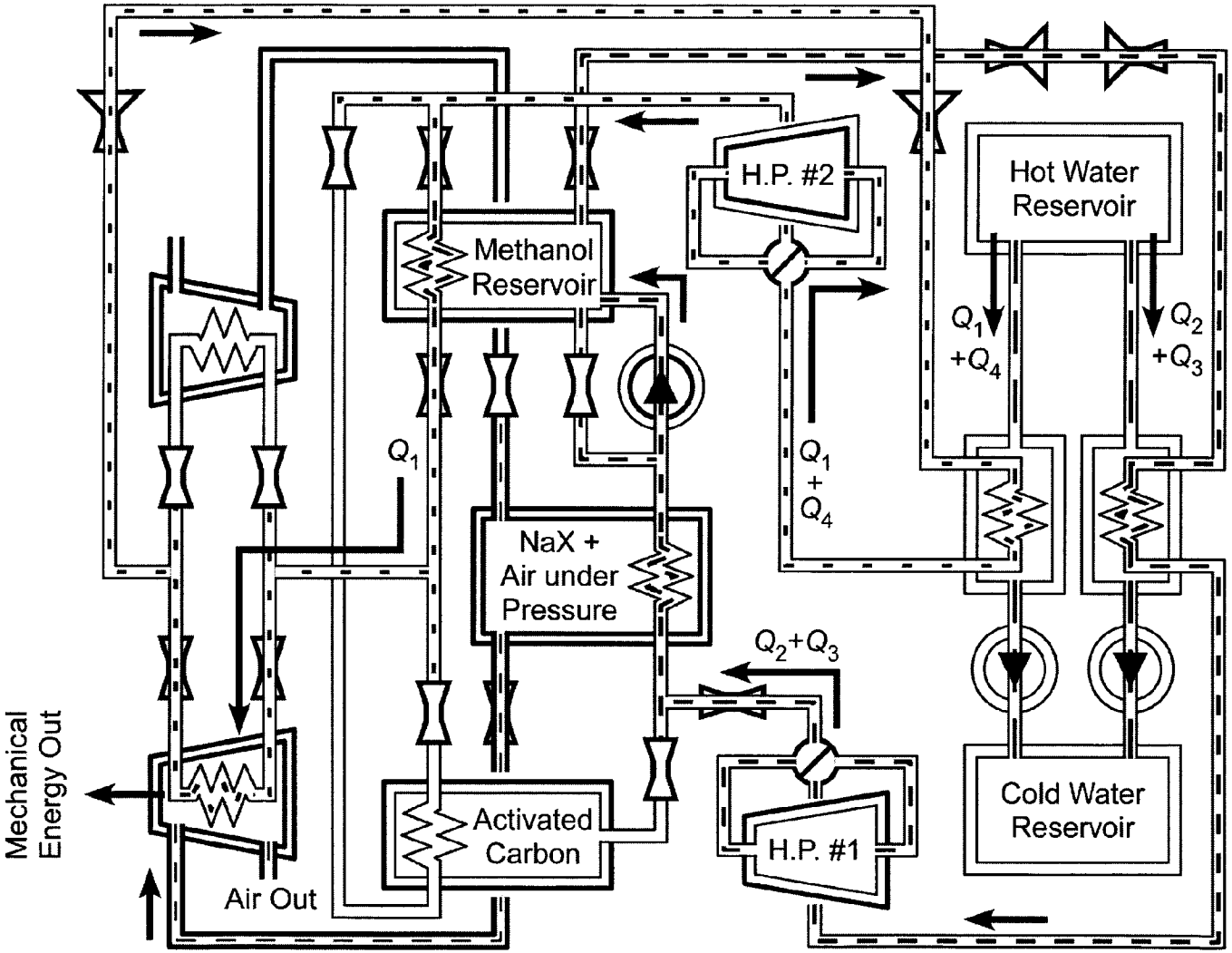
FIG. 18 is a simplified process flow diagram illustrating the mass and energy flows in the second adsorption-enhanced compressed air energy storage embodiment during the fourth leg of the storage cycle for second half of the discharging process)

The arrows adjacent the piping in FIG. 15 indicate the direction of flow of the various working fluids therein, in some instances labeled by the heat these carry between the various thermal reservoirs, during the first leg of the storage cycle (or initial half of the charging process). The heat produced by the compression of the air is labeled as $Q_1$, while the heat taken from the methanol reservoir is labeled as $Q_4$. The heat produced by adsorption of the air to the NaX is labeled as $Q_2$, and the additional sensible heat taken from the NaX bed as it cools down towards ambient temperatures is labeled as $Q_3$. Similarly, the arrows in FIG. 16 indicate the flows of the various working fluids, where the labels $Q_1$, $Q_2$ and $Q_3$ stand for these same components of the overall heat transferred to the hot water reservoir during the second leg of the storage cycle, and $Q_5$ stands for the heat of adsorption of the methanol to the activated carbon bed. The arrows in FIGS. 17 and 18 likewise indicate the direction of flow in the adjacent pipes, and the labels stand for these same components of the overall heat transferred back from the hot water reservoir to the rest of the system during the third and fourth legs (discharging portion) of the storage cycle, respectively. As previously emphasized, for ease of presentation we are disregarding the thermal energy losses concomitant upon all these heat transfers which, in most practical applications, must be made up for using an external heat source of some kind.

FIGS. 19 through 22 show much more detailed process flow diagrams of the AE-CAES system of the second embodiment at the same four points of the overall charge-discharge cycle as FIGS. 15 through 18, respectively. The numbers of the components in FIGS. 19 through 22 are the same as in the corresponding FIGS. 7 and 8 of the first embodiment in those cases in which the components serve similar functions, and otherwise the numbers continue consecutively from those of the first embodiment. Note also that, just as in FIGS. 7 and 8, FIGS. 19 through 22 have a parallel pair of dashed lines with white space between them extending from top to bottom, which are intended to indicate that the scale of the embodiment is to some extent arbitrary, and that the relative sizes of the various subsystems, the number of repeated components in them and the like are not essential to the embodiment, but could be varied substantially without altering the embodiment's ability to store and regenerate mechanical energy.

Specifically it may be seen that, just as in the first embodiment, the NaX pellet beds 1 (heavy rectangular hatching) which adsorb the compressed air are contained, in an array of cylinders with walls 2 formed from aluminum or other pressure-resistant, heat-conductive material, each with a perforated rigid tube 3 extending through its length to provide structural support and to facilitate the flow of air through the bed. Note however that in FIGS. 19 through 22 the compressed air is indicated by covering the space it fills with a pattern of heavy square dots, instead of the left-to-right upwards-slanted hatching that was used for this purpose in FIGS. 7 and 8 of the first embodiment. The array of cylinders with walls 2 is once again contained in a larger tank with a thermally insulated (as indicated by the brick-like hatching) wall 4 that is used to confine the methanol heat transfer fluid (left-to-right downwards-slanted hatching) by which the cylinders and the NaX beds in them are cooled or heated while charging or discharging the system with compressed air, respectively. When charging the system, methanol liquid (heavy hatching) is sprayed through the nozzles 8 onto the tops of the cylinders in order to cool them as it flows down their sides and evaporates, whereas when charging the system methanol vapor (light hatching) is sucked into the tank with wall 4 through the perforated tubes 5 below the cylinders in order to heat them as it condenses on their sides. The methanol vapor produced by evaporation exits the tank with wall 4 through the vents 9 in its roof, while the methanol liquid from condensation exits through a drain 6 in its floor. The wall 4 of the temperature-control tank could be economically formed from fiberglass thick enough to withstand the pressure variations within it, which may range from several atmospheres to a few hundred torr, depending on the temperature in the tank at any given point in the cycle.

Other subsystems of the second embodiment that are similar to those of the first embodiment are the methanol holding tank and pump (components 7 & 12), the thermally insulated methanol reservoir with embedded heat exchanger (components 14, 15 & 16), the methanol-based vapor-compression heat pump and heat exchanger (components 18, 19 and 20, 21), the tandem pair of centrifugal air compressors (components 25 through 29), and an expansion turbine that uses the mixer-ejector principle to keep the compressed air from cooling as it expands and regenerate the stored mechanical energy by efficiently mixing it with warm unpressurized air (indicated by filling the space it occupies with a pattern of light square dots in the figures) in the process (components 52 through 56). One small but significant refinement in this last subsystem is its use of a converging-diverging (or de Laval) nozzle to improve the suction efficiency, where the diverging portion is numbered 57 in FIGS. 19 through 22. This arrangement is an instance of a constant-pressure ejector (see e.g., J. M. Abdulateef, K. Sopian, M. A. Alghoul and M. Y. Sulaiman, Renew, Sustain. Energy Rev, 13, 1338-1349, 2009).

Figure 19:
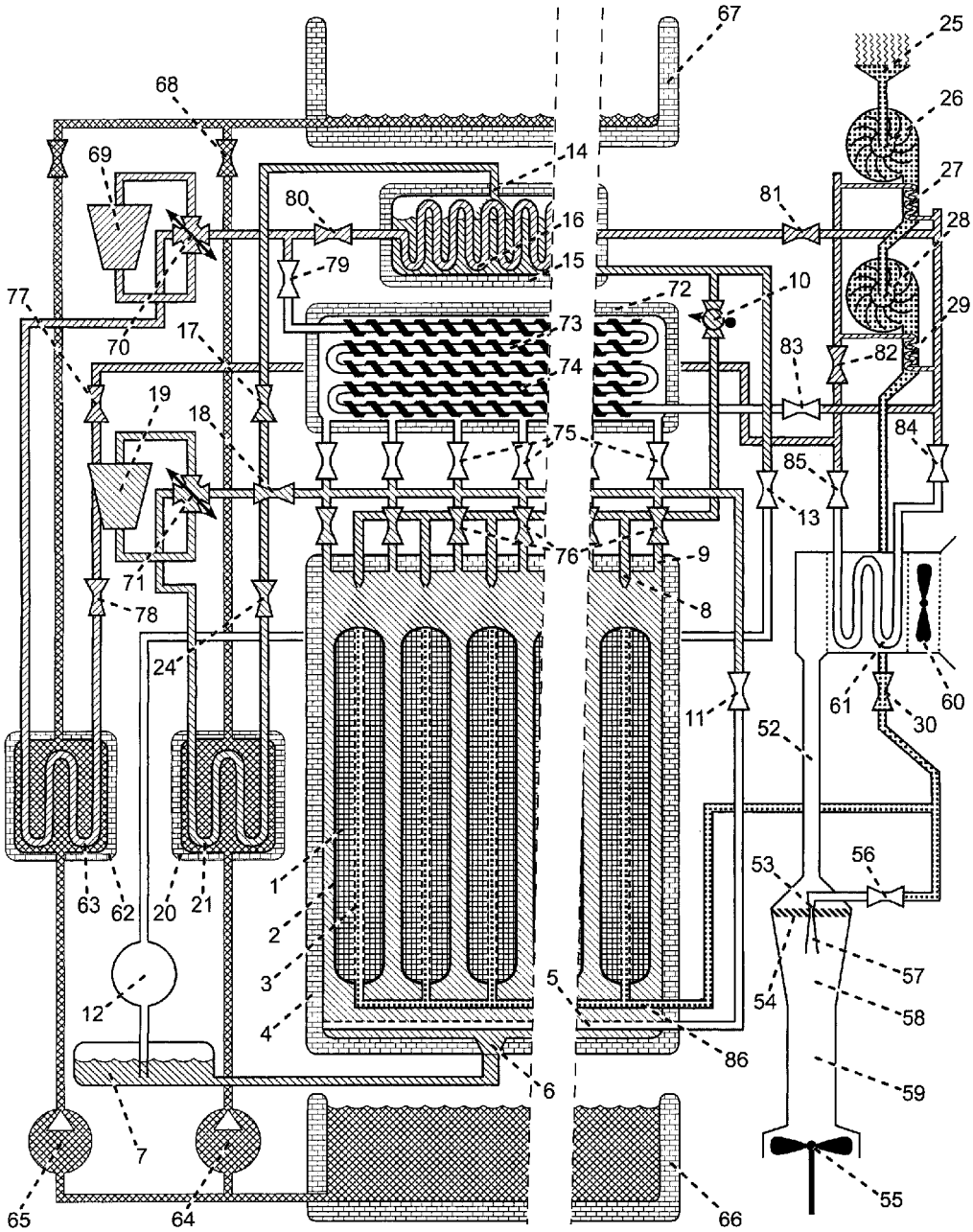
FIG. 19 is a detailed process flow diagram which shows the internal structures of the key subsystems of the second adsorption-enhanced compressed air energy storage embodiment and mass flows among them during the first leg of the storage cycle.

Looking now specifically at FIG. 19, the charging process begins with the NaX beds 1 in the cylinders with walls 2 at 100° C. and the air pressure in them at 10 bar gauge. All the water is in the cold (ambient temperature) water reservoir with thermally insulated walls 66, while essentially all the methanol is in the reservoir with walls 15. The pumps 64 and 65 are turned on to move water from the cold to the hot water reservoir with walls 67 at a controlled rate, passing through the heat exchangers' thermally insulated tanks with wails 20 and 62 as it does so. At the same time the compressors 19 and 69 of the vapor-compression heat pumps (H.P. #1 and H.P. #2 respectively in FIGS. 15 through 18) are turned on, and the four-way valves 71 and 70 are set so that the heat is transferred to the water via the heat exchangers 21 and 63 in the tanks with walls 20 and 62, respectively, as it is pumped through them. The control valve 10 is opened to allow liquid methanol to flow from the reservoir with walls 15 through the nozzles 8 onto the cylinders with walls 2 which contain the hot NaX beds 1, where it cools the NaX beds 1 by evaporation off the walls 2 and exits the thermally insulated tank with walls 4 via the vents 9 in its top as previously described. From there it is sucked through the open valves 76 into the compressor 19, and the hot compressed vapor exiting it is cooled by the water as the vapor passes through the heat exchanger 21. The vapor then partially liquefies as it passes through the pressure-reducing valve 24, and the liquid-vapor mixture returns to the reservoir with wall 15 via the port 14 in its top. Similarly, the hot compressed halocarbon refrigerant vapor exiting the compressor 69 is cooled by the water as it passes through the heat exchanger 63, and partially liquefies as it passes through the pressure-reducing valve 78. This liquid-vapor mixture then passes through the heat exchangers 27 and 29 of the compressors 26 and 28, where it cools the air following the corresponding two stages of compression to 16 bar gauge. The air passes through the filter and dryer 25 before entering the first stage of compression, and is directed via the manifold 86 to the NaX beds 1 in the cylinders with walls 2 after exiting the second stage. Meanwhile the still partially liquid refrigerant exiting the heat exchangers 27 and 29 continues on to the heat exchanger 16 in the methanol reservoir with walls 15, where completely vaporizes taking heat from the methanol reservoir as it does so and cooling it for more effective use in the next leg of the cycle, which will now be described.

Figure 20:
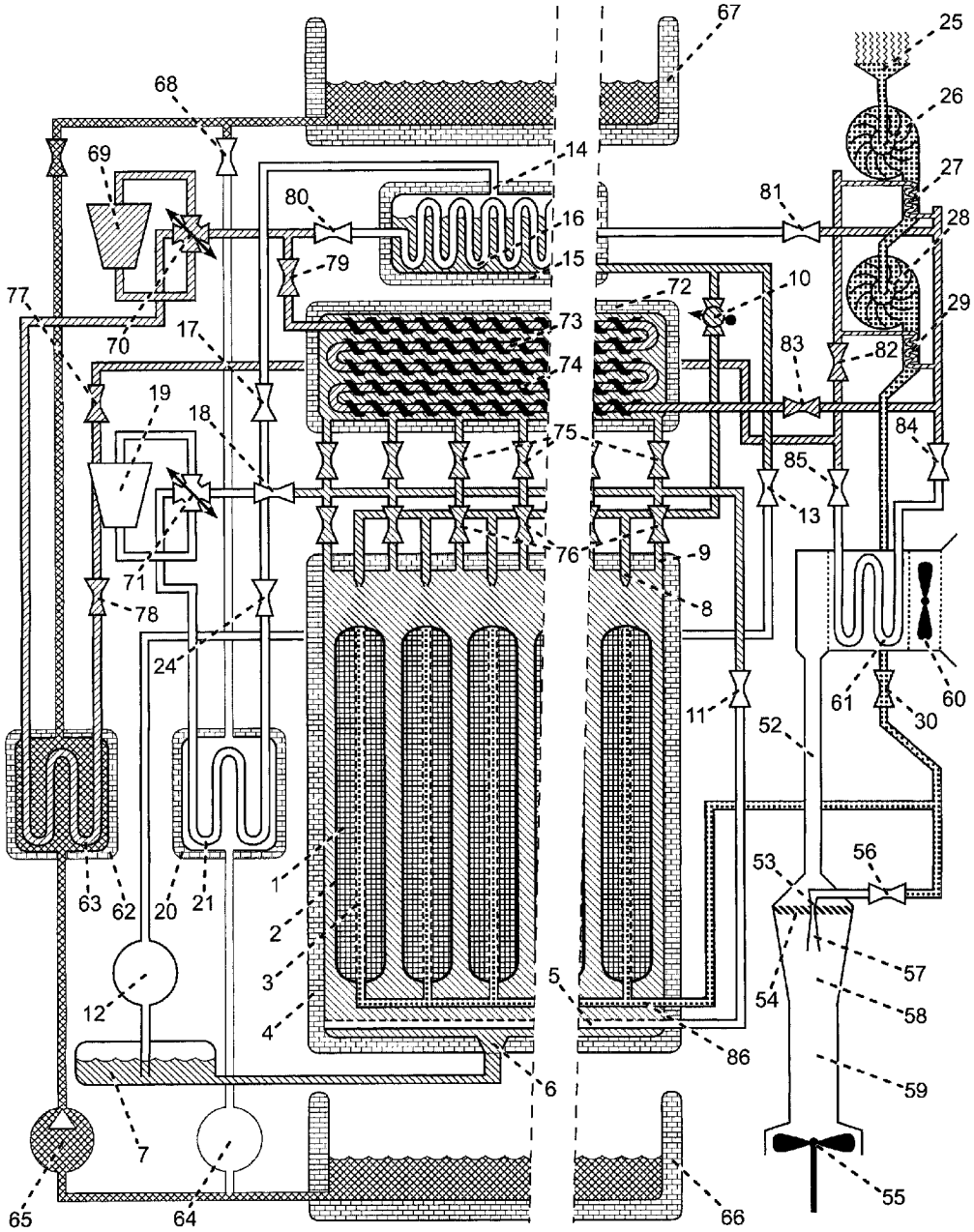
FIG. 20 is a detailed process flow diagram which shows the internal structures of the key subsystems of the second adsorption-enhanced compressed air energy storage embodiment and mass flows among them during the second leg of the storage cycle.

Turning next to FIG. 20, the second leg of the cycle begins with the NaX beds 1 at near-ambient temperatures (~25° C.) and with roughly equal amounts of water in the cold and hot water reservoirs with walls 66 and 67, respectively. The methanol compressor 19 and corresponding water pump 64 are turned off, and the valve 68 is closed to make sure water does not flow through that pathway. Similarly the valve 18 is shut, and the valves 75 leading to the thermally insulated tank with wall 72 containing the activated carbon 74 opened. As a result the methanol vapor, instead of returning to the reservoir with wall 15, is adsorbed by the activated carbon, which in turn is cooled by the conventional halocarbon refrigerant as it passes through the heat exchanger 73. This is done by closing the valves 80 and 81 leading to the methanol reservoir's heat exchanger 16 and opening the valves 79 and 83 instead. The other subsystems continue to operate exactly as in the first leg of the cycle described above. It should be noted that in order for the adsorption refrigeration subsystem to attain a sufficient specific cooling power as the temperature drops to −40° C., it may be necessary to blow a carrier gas such as air between the insulated tanks with walls 4 and 72, although the fan and other components needed to achieve this have been omitted for simplicity.

The black diagonal bands signifying the activated carbon 74 in FIGS. 19 through 22 are intended to indicate that it is formed into a fibrous ribbon which is wrapped around the heat exchanger 73 so as to improve the thermal contact between the activated carbon and heat exchanger, as described for example in [Hamamoto et al., *Intnl. J. Refrig.* 29 (2006), 305]. The exact form of the activated carbon is however not essential to the embodiment, and many other forms such as a monolith or granules of carbon could be utilized. It is also possible that another adsorbent entirely, such as a zeolite or silica gel, could be employed. Neither is the use of methanol as the primary refrigerant in any way essential to the invention, and indeed a greater specific cooling power would be expected from a more volatile refrigerant such as ammonia at low temperatures, albeit at the expense of much higher pressures in the tank with walls 4 during the high-temperature portion of the cycle. A mixture of refrigerants such as methanol and ammonia may also provide the optimum compromise in other embodiments which similarly utilize an adsorption refrigerator of some kind to cool the porous material to which air is adsorbed. The existence of these and many other well-known variations serves to emphasize that the exact implementation of the adsorption refrigerator utilized is not essential to the invention, and it is also possible that other kinds of heat-driven refrigerators such as absorption systems or thermo-compressors could be advantageous in some applications of AE-CAES.

Figure 21:
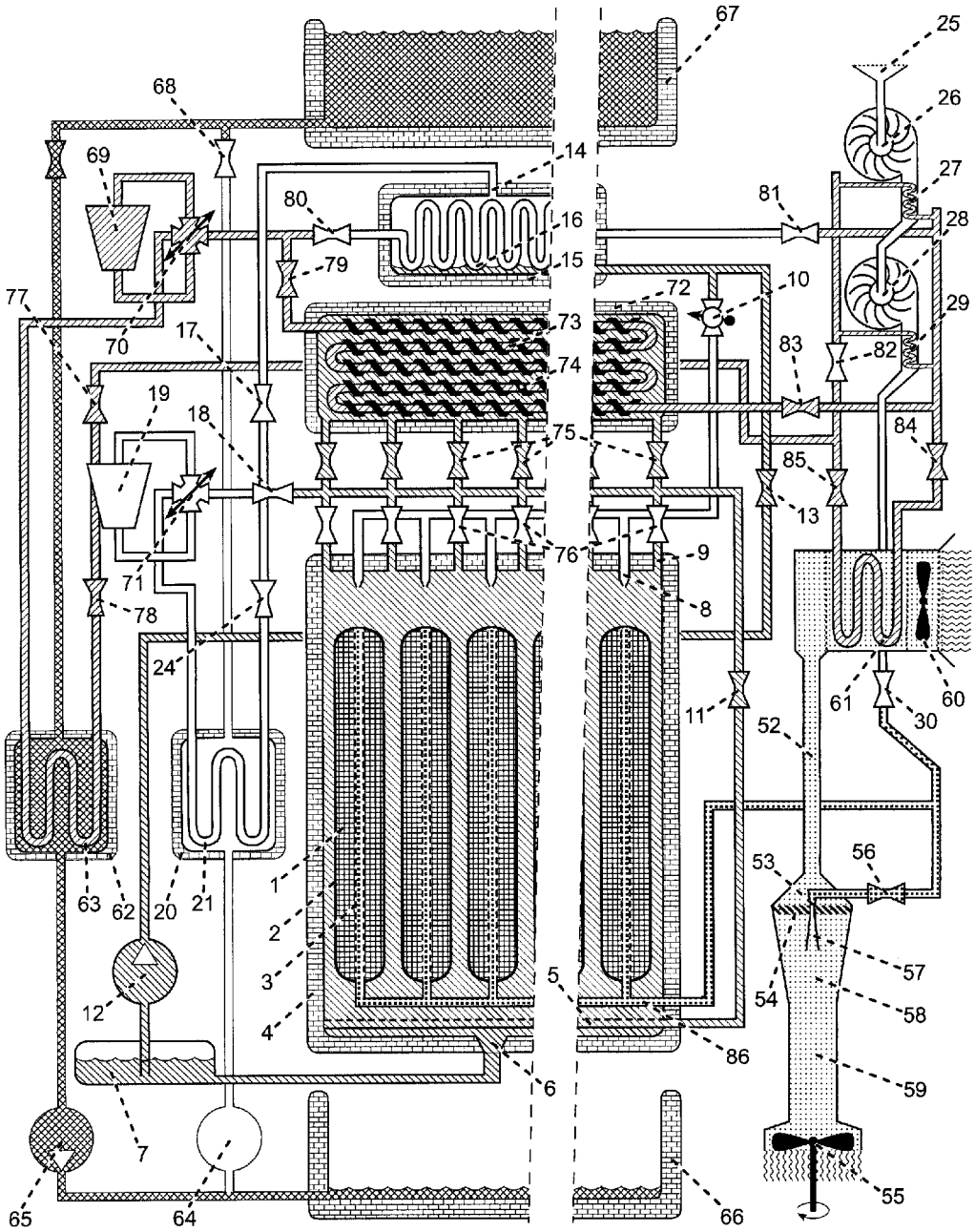
FIG. 21 is a detailed process flow diagram which shows the internal structures of the key subsystems of the second adsorption-enhanced compressed air energy storage embodiment and mass flows among them during the third leg of the storage cycle.

Looking now at FIG. 21, the discharging process begins with the NaX beds 1 in the cylinders with walls 2 at −40° C. but still under an air pressure of 10 bar gauge. All the water is in the hot water reservoir with wail 67, and all the methanol that was in the methanol reservoir with wall 15 has been adsorbed by the activated carbon 74 in the thermally insulated tank with wall 72. The compressed air is desorbed from the NaX beds 1 by increasing their temperature in a controlled fashion. This is done by closing the control valve 10 and setting the four-way valve 70 so that the hot, pressurized vapor exiting the heat pump compressor 69 passes through the heat exchanger 73 in thermal contact with the activated carbon 74, thereby raising the latter's temperature and causing methanol vapor to desorb from it. The valves 76 leading to ports at the top of the temperature-control tank with wall 4 are closed, and the valve 11 is opened so that this methanol vapor now flows down the pressure gradient leading to the perforated tubing 5 at the bottom of the temperature-control tank, where it rises by virtue of its higher temperature and hence lower density. As it encounters the cold cylinders with walls 2, it condenses on them and releases its heat of condensation in the process. The liquid methanol runs down the sides of the cylinders and exits the temperature-control tank through the drain 6 in its bottom, from which it is directed to the holding tank 7. The positive-displacement pump 12 then drives it back through the now open valve 13 to the methanol reservoir tank with wall 15. The heat that is imparted to the activated carbon 74 by the heat exchanger 73 comes from the hot water reservoir with wall 67. This heat is transferred to the conventional halocarbon refrigerant flowing through the heat exchanger 63 as the water is driven through the surrounding tank with wall 52 by the pump 65 to the cold water reservoir with wall 66. This process causes the halocarbon refrigerant to boil under the reduced pressure in the heat exchanger 62, and the resulting vapor is sucked into the compressor 69, from which it exits at an elevated temperature and pressure. This same hot pressurized halocarbon refrigerant is also used to heat the expanding air, as will now be described.

Continuing with the first part of the discharge process and FIG. 21, the air compressor subsystem 25 through 29 is turned off and the valve 30 shut to isolate it from the rest of the system. The air expander subsystem with components 52 though 59 is turned on by opening the valve 56 leading to the compressed air storage subsystem including components 1 through 4. In addition, the fan 60 is turned on to bring additional ambient air into the expander subsystem, passing as it does so over the heat exchanger 61 through which the conventional halocarbon vapor exiting the heat exchanger 73 is directed by opening the valves 84 and 85 while closing the valve 82 to prevent flow through the air compressor heat exchangers 27 and 29. This warm unpressurized air (indicated by filling the space it occupies with a pattern of light square dots) passes via the duct 52 to the stator blades 54, which impart vorticity to the warm air as it is sucked through them. This suction is generated by the compressed air as it passes through the converging-diverging nozzle, reaching Mach speed as it exits the converging region 53 and supersonic speed as it exits the diverging region 57 with a pressure which is at that point well below that of the warm unpressurized air. This supersonic stream of cold air erupts into vortices as it exits the nozzle and entrains the warm air passing through the stator 54 in the converging region 58 of the ejector, where the pressure remains below ambient. The two still incompletely mixed air streams enter the constant-area region 59 at high velocity, where the vortices dissipate as they proceed to thoroughly mix the two air streams in a largely energy and momentum conserving process. Near the end of the constant area region 59, a shock wave forms that abruptly brings the air's pressure back above ambient and further reduces its speed. The ratio of the mass flow rates of the warm unpressured air and cold expanding air entering the expander subsystem is tailored so as to ensure that this rotating, subsonic but still rapidly moving, stream of air exits the constant area section 59 at a pressure slightly above ambient and also at a temperature near the normal ambient value of 25° C. This in turn ensures that the additional cooling that occurs as the air stream imparts its energy to the rotor 55 will be modest, since the pressure energy has already been largely converted into kinetic energy by the mixer-ejector subsystem with components 53, 54, 57, 58 and 59, as desired.

Figure 22:
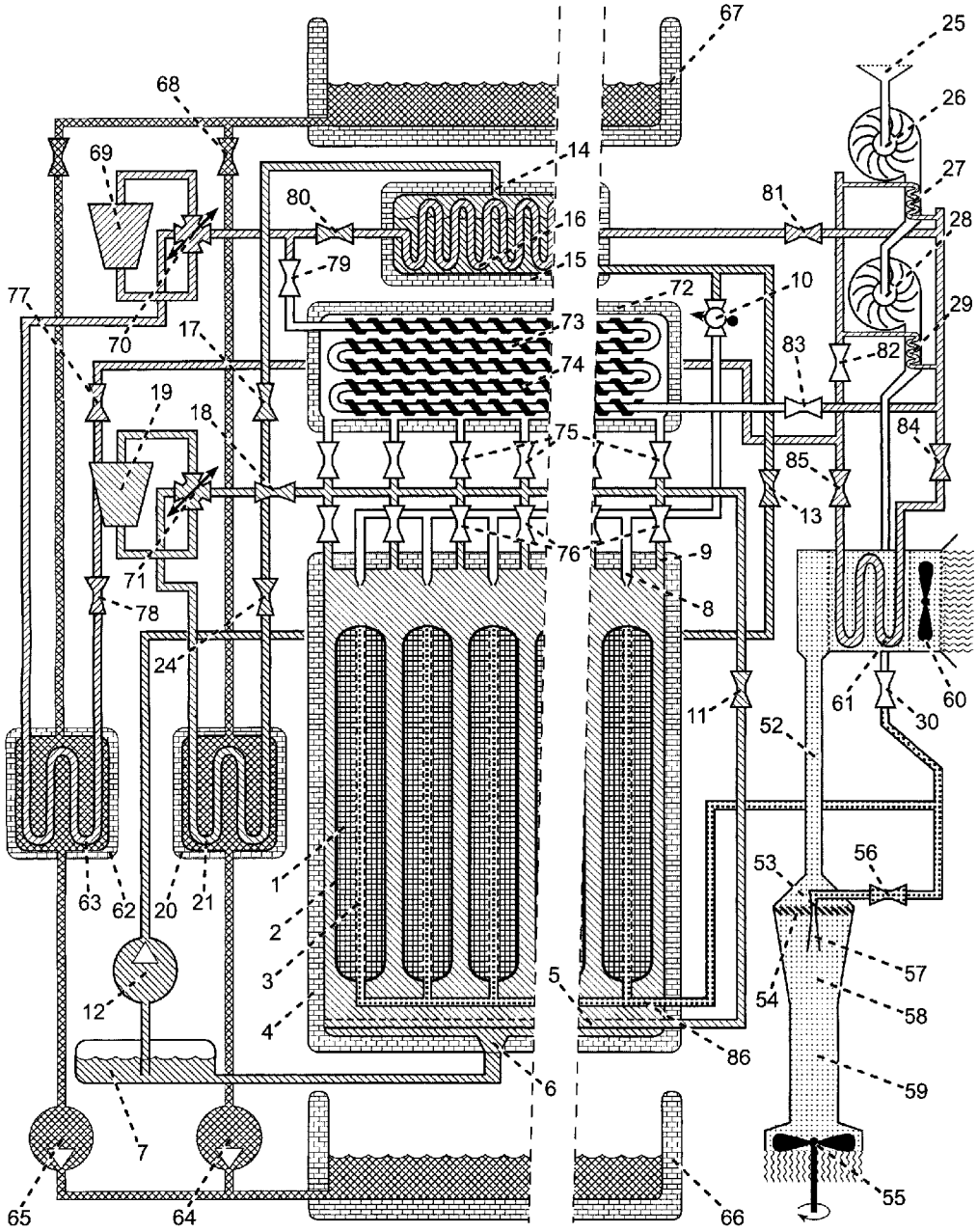
FIG. 22 is a detailed process flow diagram which shows the internal structures of the key subsystems of the second adsorption-enhanced compressed air energy storage embodiment and mass flows among them during the fourth leg of the storage cycle.

Finally, we come to the last leg of the cycle as illustrated in FIG. 22. At the beginning of this leg essentially all the methanol has been driven from the activated carbon by heating it, condensed back to a liquid by the initially cold NaX, and returned to the methanol reservoir with wall 15. The valves 75 are closed to isolate the activated carbon from the rest of the system, the valve 18 is opened, the methanol compressor 19 is turned on and the four-way valve 71 of the methanol heat pump is set so that the compressed, high-temperature methanol vapor exiting the compressor is driven through the valve 11 into the perforated tubing 5 at the bottom of the temperature-control tank with wall 4, just as it was during the previous leg of the cycle. In this way the NaX beds 1 continue to be heated towards their maximum temperature over the cycle of 100° C., while the resulting liquid methanol exiting the temperature-control tank through the drain 6 is recycled back to the methanol reservoir by the pump 12. The heat again comes from the hot water reservoir, but it is passed directly to the methanol as it boils in the heat exchanger 21 and as the hot water is driven by the pump 64 through the surrounding tank with wall 20 on its way to the cold reservoir. The methanol exits the reservoir as a vapor through the port 14 in its ceiling, and is partially, liquefied by passage through the pressure-reducing valve 17 on its way to the heat exchanger 21. The methanol in the reservoir is heated by the conventional halocarbon refrigerant to promote vaporization as it is driven by the compressor 69 through the heat exchanger 16. The halocarbon vapor then continues on to the heat exchanger 61 to warm the unpressurized air going into the mixer-ejector expansion turbine, as in the previous leg. The heat carried by the halocarbon vapor also comes from the hot water reservoir as it is driven by the pump 65 through the tank with wall 62 containing the heat exchanger on its way to the cold reservoir. By the end of this leg of the cycle the NaX beds 1 have been heated by to 100° C., and essentially all of the water has been returned to the cold water reservoir. The AE-CAES system is then ready to be recharged.

To keep the Carnot limits on the efficiency of the vapor-compression heat pumps above 90% (or coefficient of performance above 10), it is necessary to restrict the temperature lift to 35° C. for heating or 30° C. for cooling. This means that when using the methanol-based heat pump to raise the temperature of the NaX beds to 100° C. at the end of the fourth leg of the cycle, the water passing into the cold water reservoir from the heat exchanger tank with wall 20 cannot be less than 65° C., and similarly, we can cool the NaX beds down as far as 35° C. during the first leg of the cycle using the methanol-based heat pump while heating the water passing into the hot water reservoir to at most 65° C. Fortunately, during most of the fourth leg of the cycle the temperature of the NaX beds will be well below 100° C., allowing us cool the water going into the cold water reservoir quite a bit below 65° C., and similarly, during most of the first leg the NaX beds will be well above 35° C. allowing us to heat the water passing into the hot water reservoir well above 65° C. The temperature of the cold water reservoir will be no more than 25° C. while that of the hot water reservoir will be no less than 75° C., once a steady state has been reached over many charge-discharge cycles.

In order to obtain a round-trip efficiency greater than 80% for the storage and recovery of mechanical energy, the halocarbon-based heat pump should also be at least 90% efficient in both directions, with similar restrictions on the temperature lifts it can achieve. In this case, however, the maximum and minimum temperatures it must attain are less precisely defined by the embodiment, and these details may vary significantly without substantially changing the nature of the embodiment. For example, the regeneration temperature of the activated carbon will depend on the precise preparation that is utilized, even assuming its physical form is that of a fibrous ribbon. Most activated carbon preparations would be expected to lead to regeneration temperatures in the range of 60 to 90° C. at the reduced methanol pressures present while the NaX beds are below normal ambient temperatures, which is less demanding than the 100° C. assumed for the NaX beds. Similarly, it is not necessary to cool the activated carbon much below 25°0 C. in order to cool the NaX beds to −40° C. The specific activated carbon preparation utilized however, has no effect on the principles which this AE-CAES embodiment is intended to illustrate, and it is sufficient to note that those skilled in the art of adsorption refrigeration will recognize that both the cooling and heating requirements for the activated carbon should be less demanding than those assumed here for the NaX beds. Similarly, the cooling and heating requirements for the air as it is compressed to and expanded from 10 bar should be less demanding than for the NaX, especially given the mixer-ejector turbine used for the latter purpose and the fact that the air will be further cooled after it is adsorbed by the NaX beds.

Figure 23:
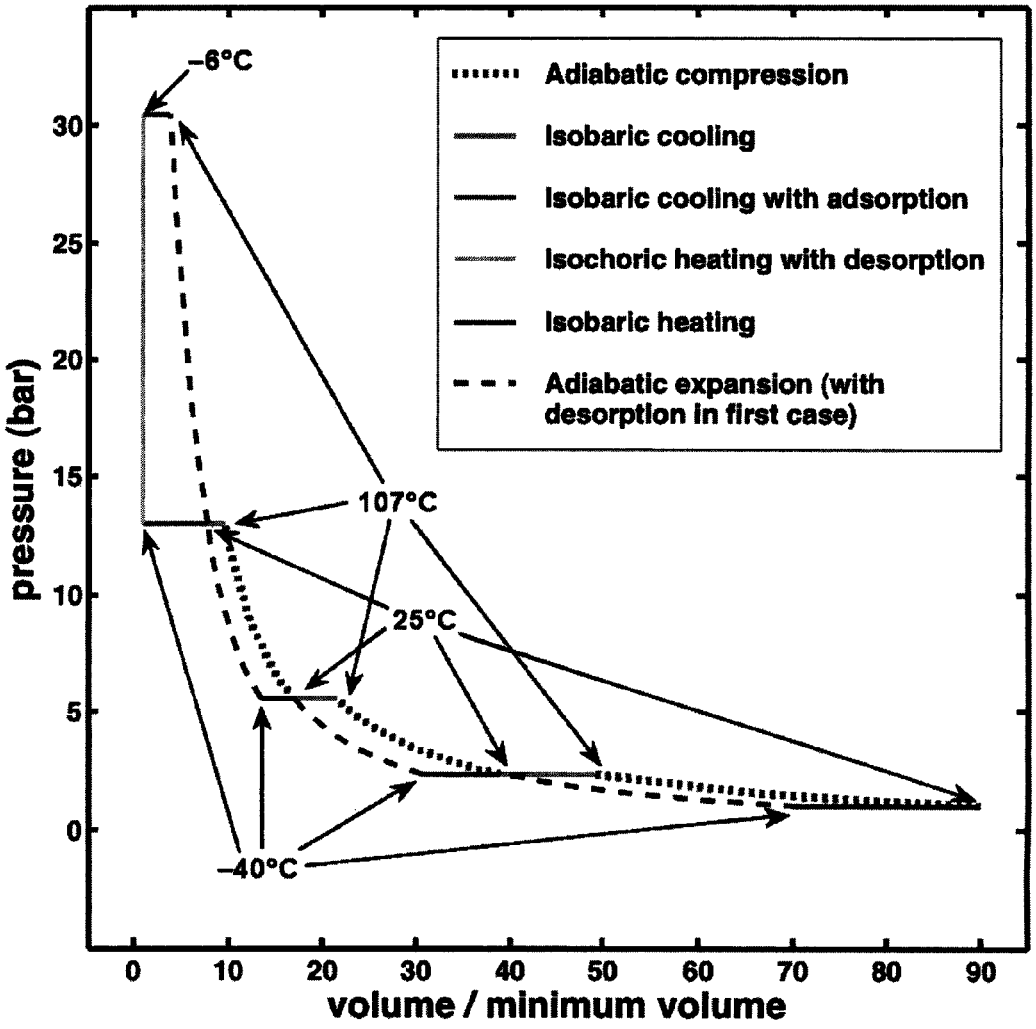
FIG. 23 depicts the pressure-volume diagram of an alternative storage cycle in which some external heat is captured by heating the fully charged NaX bed at constant volume prior to expansion, thereby compensating for the energy losses in a three-stage adiabatic compression and expansion process where each stage is followed by isobaric cooling and heating, respectively.

In the operation of an AE-CAES system, it is possible to use the processes of adsorption and desorption to harvest additional energy from a low-grade heat source. In an analogous process, boiling water in a Rankine cycle power generator converts a certain amount of the heat of vaporization directly into PV (pressure-volume) work, even before the steam has been run through a turbine. A similar process is also operative in desorption, in that a certain fraction of the heat of desorption is converted directly into PV work prior to expanding the desorbed air. If an AE-CAES system is run using a symmetric PV cycle, this stores a modest of amount of additional energy in the AE-CAES system, as was explicitly illustrated in FIG. 13. FIG. 23 shows an idealized PV-cycle that illustrates how a clockwise loop can be added to the overall cycle, allowing an AE-CAES system to also harvest a certain amount of heat energy (subject, of course, to the Carnot limits). In the idealized cycle shown, there are three stages of adiabatic compression and expansion to and from 13 bar (12 bar gauge), separated by isobaric cooling and heating to 25° C., respectively, which approximates a practical (less-than-isothermal) compression and expansion cycle. The compression stages are followed by isobaric adsorption of the air in an NaX bed as it is cooled to −40° C., greatly reducing its volume for storage. Rather than desorbing the air by the inverse isobaric process, however, the bed is allowed to warm up to −6° C. at constant volume, which raises its pressure to 30.5 bar, followed by isobaric heating to 107° C. and adiabatic expansion back to 13 bar. The rest of the expansion process then proceeds as it would in a pure storage cycle. The energy harvested is equal to the area of the enclosed by the upper left-hand loop, and is approximately equal to the areas enclosed by the three lower right-hand loops which represent the energy lost in the compression-and-expansion processes.

What is claimed is:

1. A mechanical energy storage device, comprising:

a porous material that adsorbs air;

a compressor, wherein the compressor converts mechanical energy into pressurized air and heat, wherein the pressurized air is adsorbed by the porous material;

a tank used to store the pressurized and adsorbed air;

a motor, driven to recover the stored mechanical energy by allowing the air to desorb under pressure, and the pressurized air being allowed to expand while driving the motor.

2. The mechanical energy storage device of claim 1, wherein the motor is a turbine.

3. The mechanical energy storage device of claim 2, wherein the turbine is driven by compressed air which has been expanded and accelerated without appreciable cooling by combining it with warm unpressurized air using a mixer-ejector system.

4. The mechanical energy storage device of claim 3, wherein the mixer-ejector system includes a converging-diverging nozzle to suck the warm unpressurized air into the mixer-ejector system.

5. A mechanical energy storage device, comprising the following:

a porous material that adsorbs air;

a compressor that converts mechanical energy into pressurized air and heat;

a tank that stores the pressurized and adsorbed air;

a motor, driven to recover the stored mechanical energy;

a plurality of heat pumps configured to heat or cool the porous material;

wherein the temperature of the porous material and surrounding pressurized air is controlled by allowing the heat to flow through a barrier that prevents the air from escaping;

wherein the barrier is heated or cooled by the plurality of heat pumps so as to promote the flow of heat through the barrier.

6. The mechanical energy storage device of claim 5, wherein the heat pumps are selected from the group consisting of vapor-compression heat pumps, adsorption heat pumps or absorption heat pumps.

7. The mechanical energy storage device of claim 5, wherein the heat pumps are configured to warm water while charging the device with mechanical energy or to cool water while discharging the device with mechanical energy.

8. The mechanical energy storage device of claim 7, wherein a heat source for warming the water is the porous material used to adsorb air, or the heat sink for cooling the water is the porous material used to adsorb air.

9. The mechanical energy storage device of claim 5, wherein a temperature of the porous material used to adsorb air reaches its minimum value when the amount of mechanical energy stored in the device is maximized, and the temperature of the porous material used to adsorb air reaches its maximum value when the amount of mechanical energy stored in the device is minimized.

10. The mechanical energy storage device of claim 5, wherein the heat produced by adsorbing the air, or contained in the porous material prior to adsorption, is removed to lower the temperature of the porous material and of the surrounding air, thereby keeping the pressure substantially constant during the adsorption process.

11. The mechanical energy storage device of claim 5, wherein heat is added to the porous material to compensate for the heat consumed by desorbing the air and to raise the temperature of the porous material and of the surrounding air, thereby keeping the pressure substantially constant during the desorption process.

12. The mechanical energy storage device of claim 5, wherein additional mechanical energy is generated from an external source of heat by using it to increase the temperature of the porous material before or while releasing the stored mechanical energy.

13. A mechanical energy storage device, comprising the following:

a porous material that adsorbs air;

a compressor that converts mechanical energy into pressurized air and heat; wherein the temperature of the porous material and surrounding pressurized air is controlled by allowing the heat to flow through a barrier that prevents the air from escaping;

a thermal energy storage system, wherein the heat from the pressurized air and from the porous material is directed to the thermal energy system and stored; and a tank that stores the pressurized and adsorbed air, wherein the heat stored in the thermal energy storage system is converted back into mechanical energy by allowing the air to desorb and/or expand while directing this heat back through the barrier.

14. The energy storage device of claim 13, wherein the heat is stored in sensible form.

15. The energy storage device of claim 13, wherein the heat is stored in latent form.

16. The energy storage device of claim 13, wherein additional heat is added to the thermal energy storage system to make up for the heat lost during transfer or storage.

* * * * *